US007626498B2

(12) United States Patent
Aiki et al.

(10) Patent No.: US 7,626,498 B2
(45) Date of Patent: Dec. 1, 2009

(54) SENSOR NODE

(75) Inventors: Kiyoshi Aiki, Hachioji (JP); Hiroyuki Kuriyama, Kawasaki (JP); Shunzo Yamashita, Musashino (JP); Takanori Shimura, Chiba (JP)

(73) Assignee: Hitachi, Ltd., Tokyo (JP)

( * ) Notice: Subject to any disclaimer, the term of this patent is extended or adjusted under 35 U.S.C. 154(b) by 88 days.

(21) Appl. No.: 11/208,632

(22) Filed: Aug. 23, 2005

(65) Prior Publication Data

US 2007/0030154 A1 Feb. 8, 2007

(30) Foreign Application Priority Data

Apr. 8, 2005 (JP) ..... 2005-112477

(51) Int. Cl.
*G08B 1/08* (2006.01)

(52) U.S. Cl. ..... 340/539.12; 340/539.11; 340/573.1; 600/301; 600/310

(58) Field of Classification Search ..... 340/539.1, 340/539.11, 539.12, 573.1, 571.1; 600/300, 600/301, 310; 706/924; 128/920–925
See application file for complete search history.

(56) References Cited

U.S. PATENT DOCUMENTS 5,615,685 A * 4/1997 Suga ..... 600/300
6,292,139 B1 * 9/2001 Yamamoto et al. .... 343/700 MS
6,608,562 B1 8/2003 Kimura et al.
7,127,370 B2 * 10/2006 Kelly et al. ..... 702/151
2003/0181817 A1 9/2003 Mori
2004/0094613 A1 * 5/2004 Shiratori et al. ..... 235/105
2005/0088296 A1 * 4/2005 Lee ..... 340/539.12
2006/0214805 A1 * 9/2006 Boujon ..... 340/573.1

FOREIGN PATENT DOCUMENTS

GB 2 379 016 A 7/2001
JP 10-155743 6/1998
JP 2001-070264 3/2001
JP 2002-200051 7/2002
JP 2003-010265 1/2003
JP 2003-102692 4/2003
JP 2003-275183 9/2003
JP 2004-139345 5/2004
JP 2004-312707 11/2004

OTHER PUBLICATIONS

Office Action from Chinese Patent Office mailed Feb. 13, 2009, in Chinese.

* cited by examiner

*Primary Examiner*—Daniel Wu
*Assistant Examiner*—Hongmin Fan
(74) *Attorney, Agent, or Firm*—Stites & Harbison PLLC; Juan Carlos A. Marquez, Esq.

(57) ABSTRACT

To secure a stable radio-communication performance in a sensor node, the sensor node with a radio-communication circuit and a sensor, for transmitting data measured by the sensor through radio-communication, includes a first board BO2 on which an antenna ANT1 connected to the radio-communication circuit is placed, a case CASE1 containing the first board BO2, and a band that is attached to the case CASE1 so as to fix the case CASE1 to the skin. The antenna ANT1 is placed in an upper portion of the case CASE1, which corresponds to a 12 o'clock direction of a wristwatch.

22 Claims, 23 Drawing Sheets

| SENSOR NODE ID | SENSOR ID | VALUE | TIME | • • • |
|---|---|---|---|---|
| #1 | #1(TEMPERATURE) | +25°C | 19:49 | |
| #1 | #2(ACCELERATION) | 0.1cm/s | 19:50 | |
| #1 | #3(PULSEBEAT) | 50/min | 19:52 | |
| #2 | #1(TEMPERATURE) | +24°C | 20:05 | |
| ⋮ | ⋮ | ⋮ | ⋮ | ⋮ |

SDB1

FIG.5A
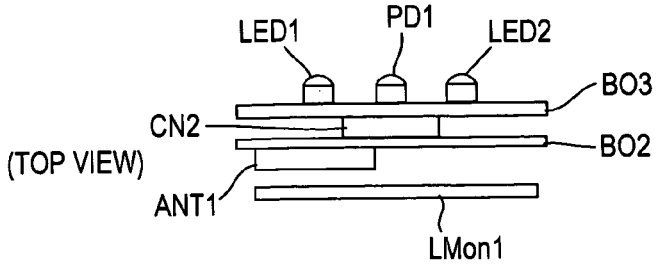
FIG.5B
(FRONT VIEW)
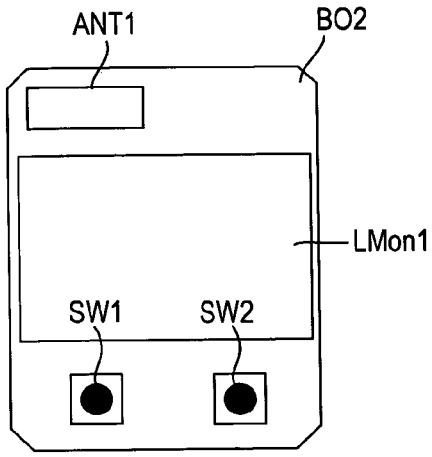
(RIGHT-SIDE VIEW)
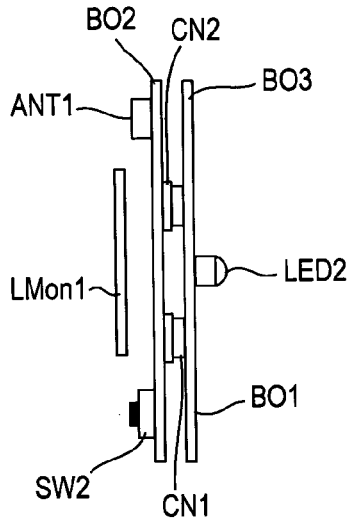
FIG.5E
FIG.5C
(BOTTOM VIEW)
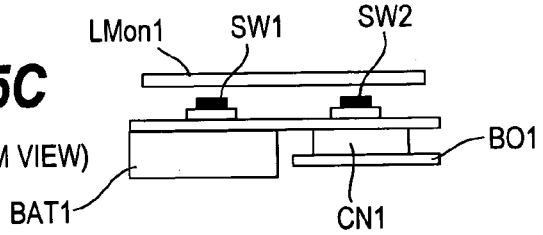
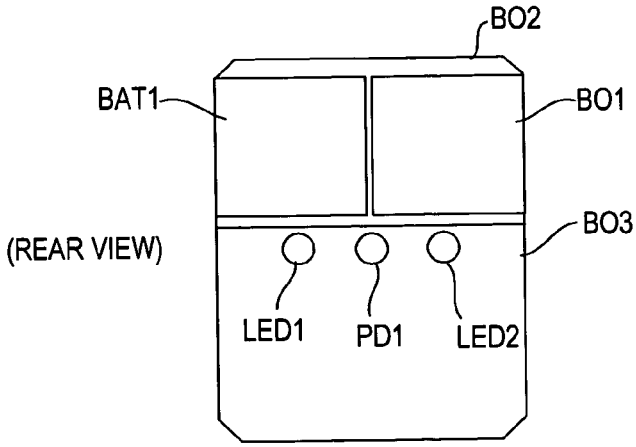
FIG.5D

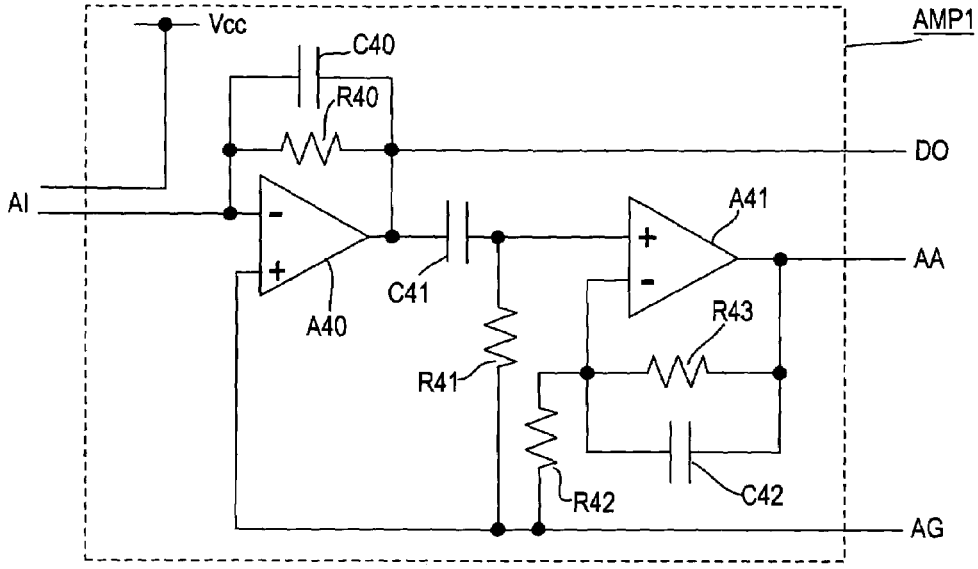
FIG.24
FIG.25A
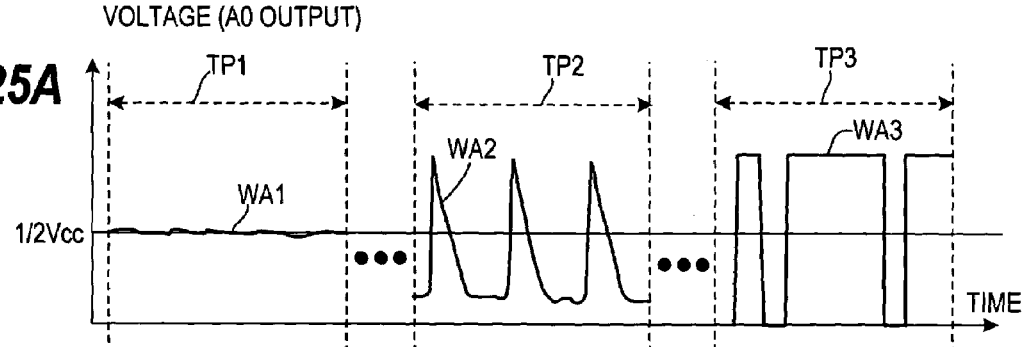
FIG.25B
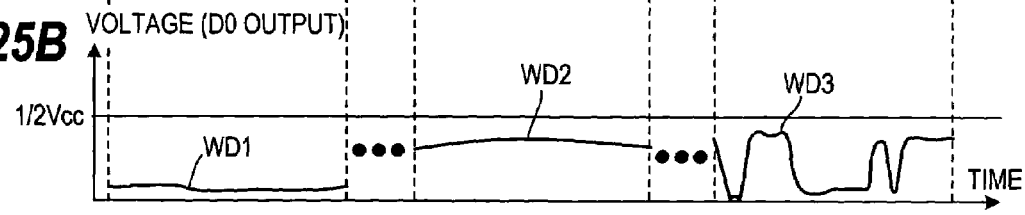

| | CURRENT CONSUMPTION |
|---|---|
| I0(STANDBY) | ~1 μA |
| I1(MICROPROCESSOR CHIP) | ~5mA |
| I2(TEMPERATURE SENSOR) | ~5 μA |
| I3(ACCELERATION SENSOR) | ~0.5mA |
| I4(PULSEBEAT SENSOR) | 10~50mA |
| I5(RF CHIP) | ~20mA |

SENSOR NODE

CLAIM OF PRIORITY

The present application claims priority from Japanese application P2005-112477 filed on Apr. 8, 2005, the content of which is hereby incorporated by reference into this application.

BACKGROUND OF THE INVENTION

This invention relates to improvement of a sensor node with a radio-communication function usable on a sensor net, in particular, a sensor node wearable to a human body.

Recently, a network system (hereinafter, referred to as a "sensor net") has been studied, in which a small electronic circuit having a radio-communication function is added to a sensor to introduce various pieces of information in a real world into an information processing apparatus in real time. A wide range of applications have been considered for the sensor net. For example, there is a medical application, in which biological information such as a pulsebeat is always monitored by a small electronic circuit with a radio circuit, a processor, a sensor, and a battery integrated thereon, monitored results are sent to a diagnosis apparatus through radio-communication, and a user's health condition is determined based on the monitored results (e.g., JP 2003-102692 A, JP10-155743 A, JP 2001-070264 A, JP 2002-200051 A, JP 2003-010265 A, JP 2003-275183 A, JP 2004-139345 A, and JP 2004-312707 A).

In order to put the sensor net into practical use widely, it is important to keep an electronic circuit (hereinafter, referred to as a "sensor node") on which a radio-communication function, a sensor, and a power supply such as a battery are mounted without maintenance for a long period of time, to allow the electronic circuit to continue to transmit sensor data, and also important to miniaturize the outer shape of the electronic circuit. Therefore, an ultra-small sensor node capable of being set anywhere is being developed. In this stage, in terms of a practical application, it is considered to be necessary that a sensor node can be used without exchanging a battery for about one year from both aspects of maintenance cost and ease of use.

SUMMARY OF THE INVENTION

In the above-mentioned sensor node, it is necessary to keep stable radio-communication performance without exchanging a battery for a long period of time, while it is required that a sensor node for measuring a pulsebeat and a body temperature is worn by a human body. The human body has however characteristics of reflecting a part of an electromagnetic wave and absorbing a part thereof. Therefore, in order to keep stable communication performance while the electric power required for transmission is being reduced, it is difficult to perform stable radio-communication at a low electric power unless the arrangement of a radio circuit is taken into consideration.

Further, in the sensor node worn by a human body, when there is movement of the human body or a shift in wearing position, the precision of measuring biological information decreases.

Furthermore, in the sensor node worn by a human body, it is necessary to consider the electromagnetic directivity of an antenna to be used in view of the miniaturization of a sensor node and the layout that has not been devised in the above Patent Documents in view of relationship between the battery in the sensor node and other components such as a board.

This invention has been made in view of the above-mentioned problems, and it is an object to ensure stable radio-communication performance and it is another object to provide a sensor node capable of maintaining precision of measuring biological information.

A sensor node with a radio-communication circuit and a sensor, for transmitting data measured by the sensor through radio-communication, includes a first board on which an antenna connected to the radio-communication circuit is placed, a case containing the first board, and a band that is attached to the case to fix the case to the skin, in which the antenna is placed in an upper portion of the case, which corresponds to a 12 o'clock direction of a wristwatch.

Furthermore, the antenna is placed on the first board opposed to the case, and the band is connected to the upper portion and a lower portion to be wearable to the arm.

Furthermore, the sensor includes a light-emitting element and a light-receiving element placed at a position opposed to the skin, and the light-emitting element and the light-receiving element are placed on an axis orthogonal to a center of a line connecting upper and lower directions of the case.

Thus, according to this invention, by providing the antenna of the sensor node in an upper portion of the case in the 12 o'clock direction of a wristwatch, when the sensor node is worn on the arm, the antenna can be placed at a position farthest from a human body, so sensitivity can be set to be maximized.

Furthermore, when the sensor node is worn on the arm, light-emitting elements and a light-receiving element can be placed in a line substantially along the center of the arm, so the light-emitting elements and the light-receiving element can be placed along the blood vessel flowing through the arm. Consequently, in the case of measuring a pulsebeat, the sensor node can be brought into close contact with the blood vessel targeted for sensing. This enables stable sensing, which can enhance the measurement precision.

BRIEF DESCRIPTION OF THE DRAWINGS

FIGS. 5A to 5E are views of a board unit inside a sensor node, in which FIG. 5A is a top view of the board unit; FIG. 5B is a front view of the board unit; FIG. 5C is a bottom view of the board unit; FIG. 5D is a back view of the board unit; and FIG. 5E is a right side view of the board unit.

FIGS. 16A and 16B are circuit diagrams of an example of an LED display unit (LSC1) used in the wristband sensor node in which: FIG. 16A shows an example in which an LED is driven by the amplification of a current by an inverter IV1; and FIG. 16B shows an example in which an LED is driven directly by a programmable input/output circuit PIO of a microprocessor chip.

FIG. 24 is a circuit diagram showing an example of a pulsebeat-signal amplifier AMP1 used in the wristband sensor node.

FIGS. 25A and 25B are graphs of a waveform example of a pulsebeat-signal amplifier in which: FIG. 25A shows a relationship between an output AA of the pulsebeat-signal amplifier and a time; and FIG. 25B shows a relationship between an output D0 of the pulsebeat-signal amplifier and a time.

DETAILED DESCRIPTION OF THE INVENTION

Hereinafter, this invention will be described by way of embodiments with reference to the accompanying drawings.

First Embodiment

Figure 1:
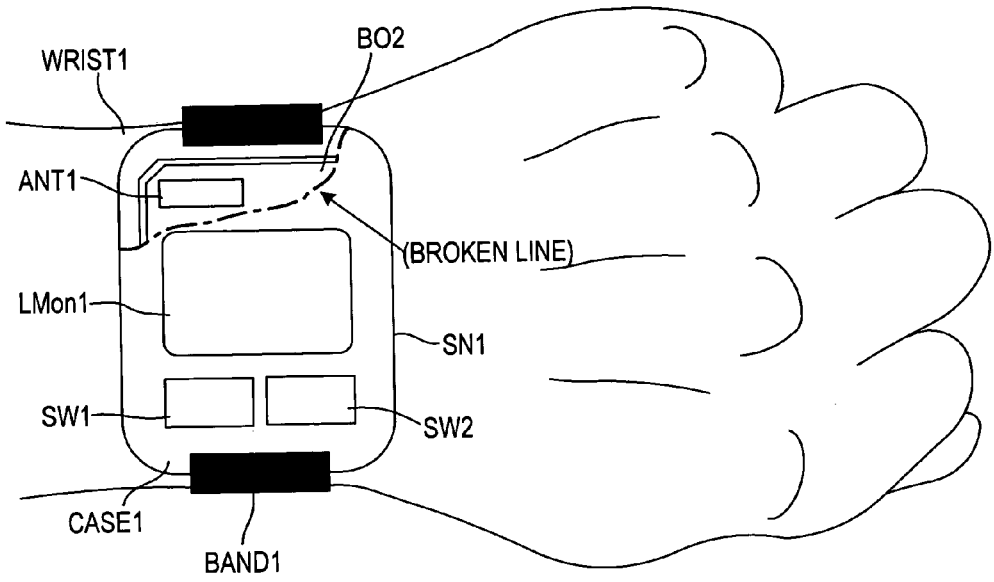
FIG. 1 is a partial perspective view showing a front surface of a wristband sensor node and arrangement of an antenna in Embodiment 1 of this invention, when the sensor node is worn on the left arm.

FIG. 1 is a front view showing an example in which this invention is applied to a wristband (or a wristwatch) sensor node SN1. The sensor node SN1 mainly measures a pulsebeat of a wearer.

<Outline of Sensor Node>

At the center of a rectangular case CASE1 having four sides, a display unit LMon1 for displaying a message and the like is placed. As the display unit LMon1, a liquid crystal display unit or the like can be used. A band BAND1 for fixing the sensor node SN1 to the arm is attached from a first side, which is an end portion of the case CASE1 in the 12 o'clock direction of a wristwatch, to a second side opposed to the first side, which is an end portion of the case CASE1 in a 6 o'clock direction of the wristwatch. FIG. 1 shows a state where the sensor node SN1 is worn on the left arm (WRIST1). Hereinafter, the 12 o'clock direction of the wristwatch will be referred to as an upper portion of the case CASE1, and the 6 o'clock direction of the wristwatch will be referred to as a lower portion of the case CASE1.

An emergency switch SW1 and a measurement switch SW2 are placed between the band BAND1 at a lower end of the case CASE1 and the display unit LMon1 on a board BO2 (described later) in the longitudinal direction of the arm, and exposed to the surface of the case CASE1 so as to be operable by the wearer. For example, the switch SW1 is operated by the wearer in emergency so that the wearer notifies the outside of an emergency, and the switch SW2 is operated by the wearer when biological information (pulsebeat, etc.) is measured, or the wearer responses to an inquiry through the display unit LMon1. As those switches, typically, although a press-button type switch can be used, switches of other types can also be used.

Then, an antenna ANT1 is placed between the band BAND1 at an upper end of the case CASE1 and the display unit LMon1 on the board (first board) BO2 inside the case CASE1. The antenna ANT1 is a chip-type dielectric antenna using a so-called high dielectric substance.

The sensor node SN1 includes a pulsebeat sensor for measuring a pulsebeat, a temperature sensor for measuring a body temperature or an ambient temperature, a sensor for detecting the movement of the wearer (living body), and typically, an acceleration sensor, as described later. Sensors of other types can also be used instead of the acceleration sensor, as long as they can detect the movement.

Figure 2:
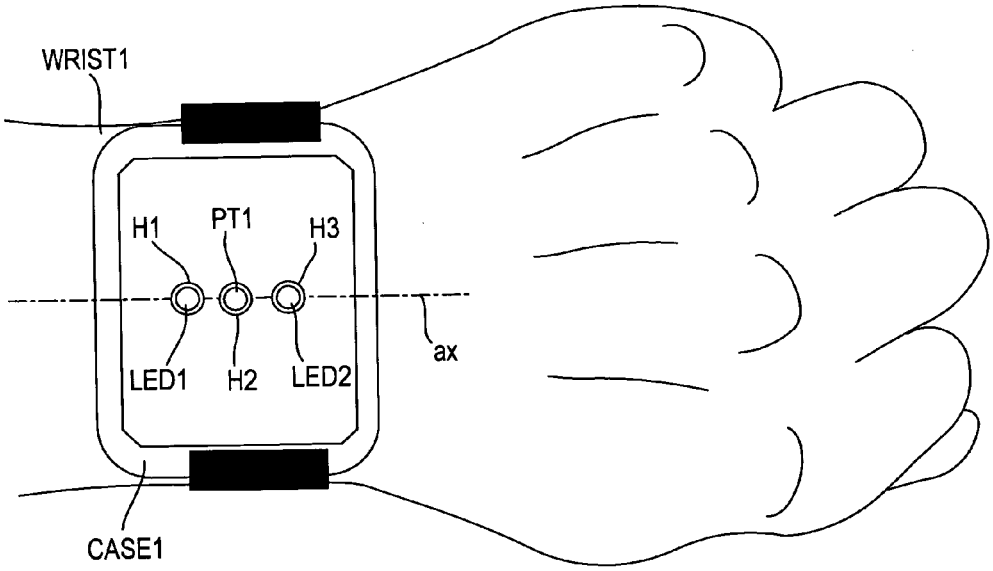
FIG. 2 illustrates arrangement of a pulsebeat sensor where a bottom surface of a case is seen through from the front surface side.

FIG. 2 illustrates the arrangement of the pulsebeat sensor placed on a bottom surface of the case CASE1. The pulsebeat sensor used in the wristband sensor node SN1 of this invention is composed of an infrared light-emitting diode and a phototransistor as a light-receiving element. As the light-receiving element, a photo diode can also be used instead of the phototransistor. In three optical windows H1 to H3 provided on the bottom surface of the case CASE1, a pair of infrared light-emitting diodes (light-emitting elements) LED1, LED2, and a phototransistor (light-receiving element) PT1 are provided, and each element is placed so as to be opposed to the skin. As a result, the pulsebeat sensor is configured.

The pulsebeat sensor irradiates infrared light generated in the infrared light-emitting diodes LED1, LED2 to the blood vessel under the skin, detects a fluctuation in strength of scattered light from the blood vessel ascribed to the fluctuation in a bloodstream at the phototransistor PT1, and estimates a pulsebeat from the period of the change in strength.

Here, the infrared light-emitting diodes LED1, LED2 and the phototransistor PT1 are placed on a board BO3 (described later) so that the infrared light-emitting diodes LED1, LED2 and the phototransistor PT1 are aligned along an axis ax orthogonal to a center portion of a line connecting the upper and lower directions (12 o'clock and 6 o'clock) of the case CASE1, on the bottom surface of the case CASE1, and the phototransistor PT1 is placed so as to be sandwiched between the infrared light-emitting diodes LED1 and LED2.

In other words, in order to obtain a pulsebeat stably, it is important to grasp the fluctuation of a bloodstream efficiently. Owing to the arrangement specific to this invention shown in FIG. 2, i.e., by arranging the infrared light-emitting diodes LED1 and LED2 and the phototransistor PT1 in a straight line, when the wristband sensor node SN1 is worn on the arm, the LED1, LED2 and phototransistor string can be arranged so as to follow the blood vessel flowing through the arm, i.e., a bloodstream in the blood vessel. Furthermore, as shown in FIG. 2, by arranging the infrared light-emitting diodes LED1, LED2 and the phototransistor PT1 at the center of the wristband sensor node SN, even when a user (wearer) moves, the infrared light-emitting diodes LED1, LED2 and the phototransistor PT1 can be brought into close contact with the arm, i.e., the blood vessel to be sensed. Consequently, the fluctuation in strength of infrared scattered light ascribed to the fluctuation of a bloodstream can be grasped stably by the phototransistor PT1.

<Outline of Sensor Net>

Figures 3, 4:
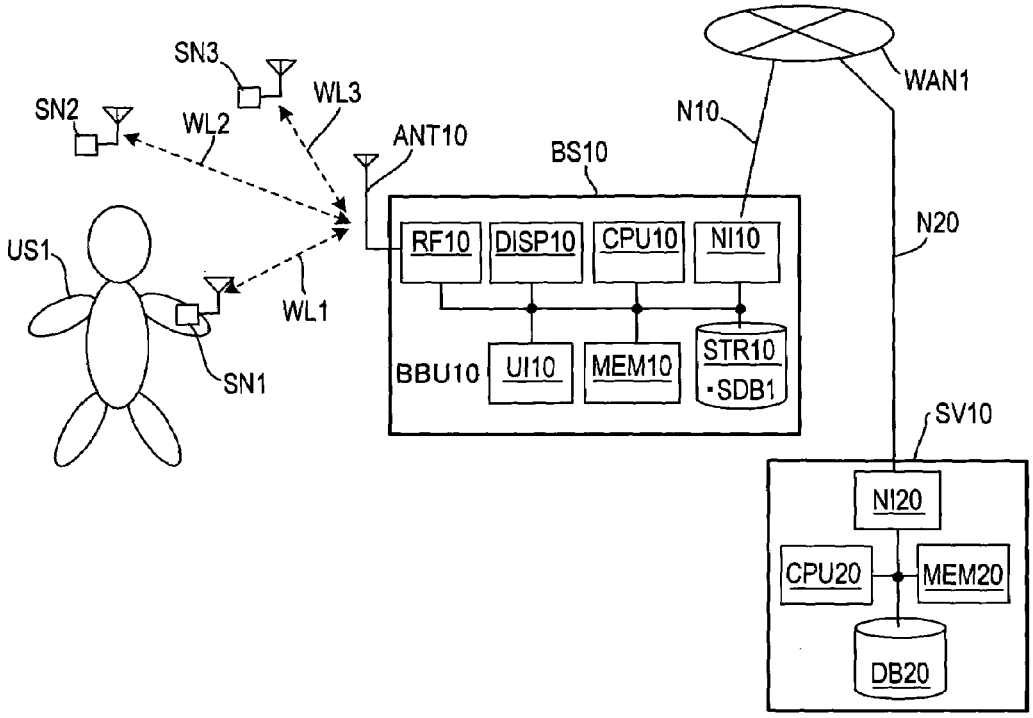
FIG. 3 is a block diagram showing an exemplary configuration of a health management sensor network system realized by the wristband sensor node of this invention.
FIG. 4 illustrates an example of sensor data collected by a basestation BS10.

FIG. 3 is a diagram showing a system configuration illustrating an, example in which a health management sensor net system is configured using the wristband sensor node SN1 of this invention.

In FIG. 3, SN1 to SN3 each denote a wristband sensor node of this invention. For example, the wristband sensor node is worn on the arm of a user for the purpose of monitoring the health condition of the user. Those wristband sensor nodes SN1 to SN3 perform radio-communication with a basestation BS10 through radio waves WL1 to WL3. Each of the sensor nodes SN1 to SN3 transmits data such as a sensed temperature, pulsebeat, or the like to the basestation BS10.

The basestation BS10 is composed of an antenna ANT10, a radio-communication interface RF10, a processor CPU10, a memory MEM10, a secondary storage STR10, a display unit DISP10, a user interface apparatus UI10, and a network interface NI10. Among them, the secondary storage STR10 is typically composed of a hard disk or the like. Furthermore, the display unit DISP10 is composed of a CRT or the like. The user interface apparatus UI10 is typically a keyboard/mouse or the like.

The basestation BS10 can also communicate with, for example, a management server SV10 at a remote place through a wide area network WAN10 via the network interface NI10, in addition to the radio-communication with the sensor nodes SN1 to SN3. The management server SV10 includes a CPU20, a memory MEM20, a secondary storage DB20, and a network interface NI20, and manages sensor data collected from the basestation BS10 using a database or the like. As the wide area network WAN10, typically, the Internet or the like can be used.

FIG. 4 shows an example of a configuration of sensor data transmitted from each of the sensor nodes SN1 to SN3 to the basestation in the health management sensor net system shown in FIG. 3, and shows an example of sensor data stored in the secondary storage STR10 of the basestation BS10.

The sensor data of each of the sensor nodes SN1 to SN3 contains identifiers (sensor node IDs) of the sensor nodes SN1 to SN3, respectively, and sensor IDs of a temperature, an acceleration, and a pulsebeat measured by each of the sensor nodes SN1 to SN3 on the sensor basis. The basestation BS10 collects a measured value, a measurement time, and the like for each sensor node ID and each sensor ID, and stores them in the secondary storage STR10. Then, the secondary storage STR10 transmits the measured sensor data periodically or in accordance with the request from the management server SV10.

<Configuration of Sensor Node>

FIGS. 5A to 5E each show the arrangement of a board unit constituting the inside of the sensor node SN1. The board unit is composed of three boards BO1 to BO3 in total with the board BO2 as a motherboard to which the antenna ANT1 and the display unit LMon1 are attached, and contained in the case CASE1 shown in FIG. 1.

In a front view of FIG. 5B, the antenna ANT1 is placed on the left side in an upper portion (12 o'clock direction of the wristwatch) of the motherboard BO2. The display unit LMon1 is placed at the center of the motherboard. An emergency switch ESW1 (corresponding to SW1 in FIG. 1) and a measurement switch GSW1 (corresponding to SW2 in FIG. 1) are placed in a lower portion (6 o'clock direction of the wristwatch) of the motherboard BO2. Then, on a reverse surface of the motherboard BO2, a battery BAT1, the board (third board) BO3 provided with the pulsebeat sensor, and the board BO1 provided with a microprocessor (control apparatus) and a communication chip are attached (see a bottom view of FIG. 5C, a back view of FIG. 5D, and a right-side view of FIG. 5E). The upper portion of the motherboard BO2 is matched with the upper portion of the case CASE1.

The motherboard BO2 is incorporated in the case CASE1 shown in FIG. 1 under the condition that the display unit LMon1 and the boards Bo1 and Bo3 are attached. In the case CASE1, the motherboard BO2 is incorporated so that the upper portion of the motherboard BO2 is matched with the upper portion of the case CASE1.

More specifically, the wristband sensor node SN1 of this invention is characterized in that the emergency switch ESW1, the measurement switch GSW1, the display unit LMon1, and the antenna ANT1 are placed in this order on the front surface side on the motherboard BO2 (front surface side of the case CASE1 in FIG. 1) from the lower portion to the upper portion of the front view of FIG. 5B, i.e., from a position close to the human body of the user (wearer) wearing the wristband sensor node SN1 to a position away from the human body.

First, in terms of the visibility of the user, it is preferable that the display unit LMon1 is placed at the center of the wristband sensor node SN1 as shown in FIG. 1. Secondly, in terms of the operability of the emergency switch ESW1/measurement switch GSW1, the display unit LMon1 is placed so that the user can operate the display unit LMon1 while watching it. In other words, preferably, this invention has such an arrangement that the switches ESW1 and GSW1 are placed below the display unit LMon1 (6 o'clock direction of the wristwatch), i.e., on the human body side. Thirdly, it is preferable that the antenna ANT1 be placed at a position where the sensitivity becomes maximum.

On the other hand, an antenna that can be contained in the wristband sensor node SN1 of this invention is a chip-type dielectric antenna using a so-called high dielectric substance because of the constraint of a size of the case CASE1. The chip-type dielectric antenna has electromagnetic directivity in a direction vertical to the antenna, as is well known.

More specifically, in the front view of FIG. 5B, the antenna ANT1 has electromagnetic directivity in upper and lower directions of the drawing surface (12 o'clock direction and 6 o'clock direction of the wristwatch). Therefore, when the antenna ANT1 is mounted on the emergency switch SW1/measurement switch SW2 side the other way around in the arrangement shown in FIG. 5B, the display unit LMon1 becomes an obstacle, which largely degrades the sensitivity. Furthermore, although the antenna ANT1 has electromagnetic directivity also in the lower direction (human body side) on the drawing surface of FIG. 5B, the arm and the human body have a ground potential seen from a radio signal with a frequency of 2.4 GHz (although not particularly limited) used by the sensor node SN1 in radio-communication, and do not transmit a radio wave. Therefore, when the antenna ANT1 is mounted on the lower side of the case CASE1, the antenna ANT1 is placed close to the human body, which remarkably degrades the sensitivity. Thus, it is optimum to arrange the antenna ANT1 in the upper portion of the case CASE1 where the sensitivity becomes maximum.

Furthermore, considering that the wristband sensor node SN1 is worn on the left arm as is often the case with a right-handed user, when the antenna ANT1 is arranged on the upper-right side of the case CASE1 in FIG. 5B, the back of the left hand influences the antenna ANT1 to decrease the sensitivity. Therefore, as shown in FIG. 5B, by arranging the antenna ANT1 on the upper-left side of the case CASE1, the antenna ANT1 can be placed at a position away from the back of the left hand. As a result, the sensitivity can be enhanced. A left-handed user wears the wristband sensor node SN1 on the right hand. Therefore by placing the antenna ANT1 on the upper-right side of the case CASE1, the influence of the back of the right hand is reduced to enhance the electromagnetic directivity of the antenna ANT1. Furthermore, according to a method for wearing the wristband sensor node SN1 with the display unit facing the same side as that of the palm as is often the case with women, the antenna ANT1 is influenced by the palm instead of the back. However, by placing the antenna ANT1 in the upper portion of the board so that it is placed in the upper portion of the case CASE1 as described above, the influence of the palm can be reduced.

Next, on the reverse surface of the motherboard BO2, the infrared light-emitting diodes LED1, LED2, and the phototransistor PT1 constituting the pulsebeat sensor are arranged on the board BO3 in series along the axis ax in FIG. 2. As illustrated in FIG. 2, the infrared light-emitting diodes LED1, LED2, and the phototransistor PT1 are set so as to be opposed to the skin from the openings (H1 to H3) provided in the case CASE1, and the board BO3 is supported on the reverse surface of the motherboard BO2. In FIG. 5E, the display unit LMon1 side is the surface side of the case CASE1, and the board BO1 and BO3 side is the bottom surface side of the case CASE1. Furthermore, the display unit LMon1, the emergency switch SW1, and the operation switch SW2 supported on the motherboard BO2 are placed on the surface side of the case CASE1, and have a configuration (not shown) in which they are respectively provided with covers so as not to be exposed to the case surface.

In the back view of FIG. 5D, in the upper portion of the board BO3 (the lower portion of the case CASE1), the battery BAT1 attached to the reverse surface of the motherboard BO2, the board BO1 provided with a microprocessor and a communication chip are placed. The board BO1 is supported on the reverse surface of the motherboard BO2. The board BO1 and the battery BAT1 are placed in the horizontal direction in FIG. 5D so as not to overlap each other. Thus, by placing the battery BAT1 and the board BO1 having some thickness on the reverse surface of the motherboard BO2, the distance can be kept between the antenna and the living body, i.e., the arm, so that the electromagnetic directivity of the antenna can be enhanced.

Next, the detail of the motherboard BO2 and the boards BO1, BO3 will be described.

Figure 6:
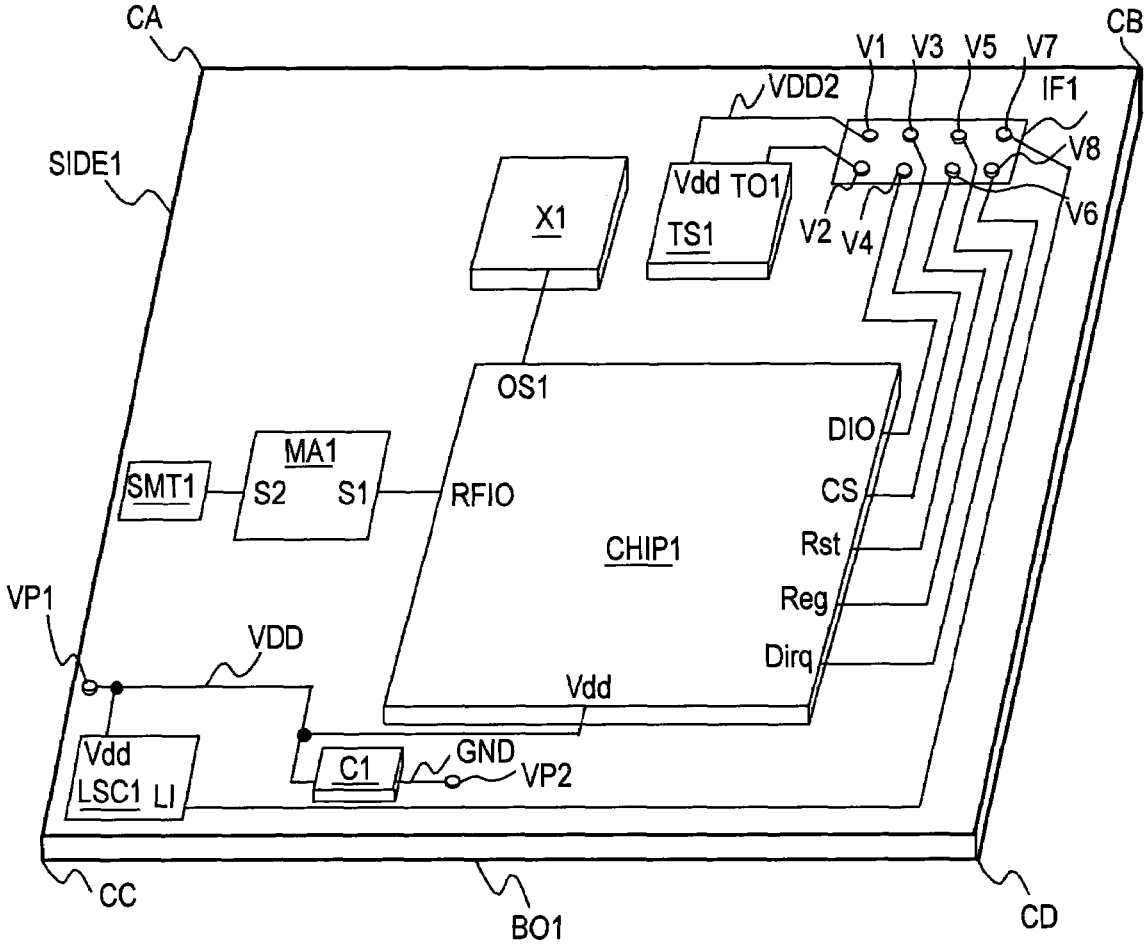
FIG. 6 is a structural diagram of a first surface (SIDE1) of a main board BO1 constituting the wristband sensor node.
Figure 7:
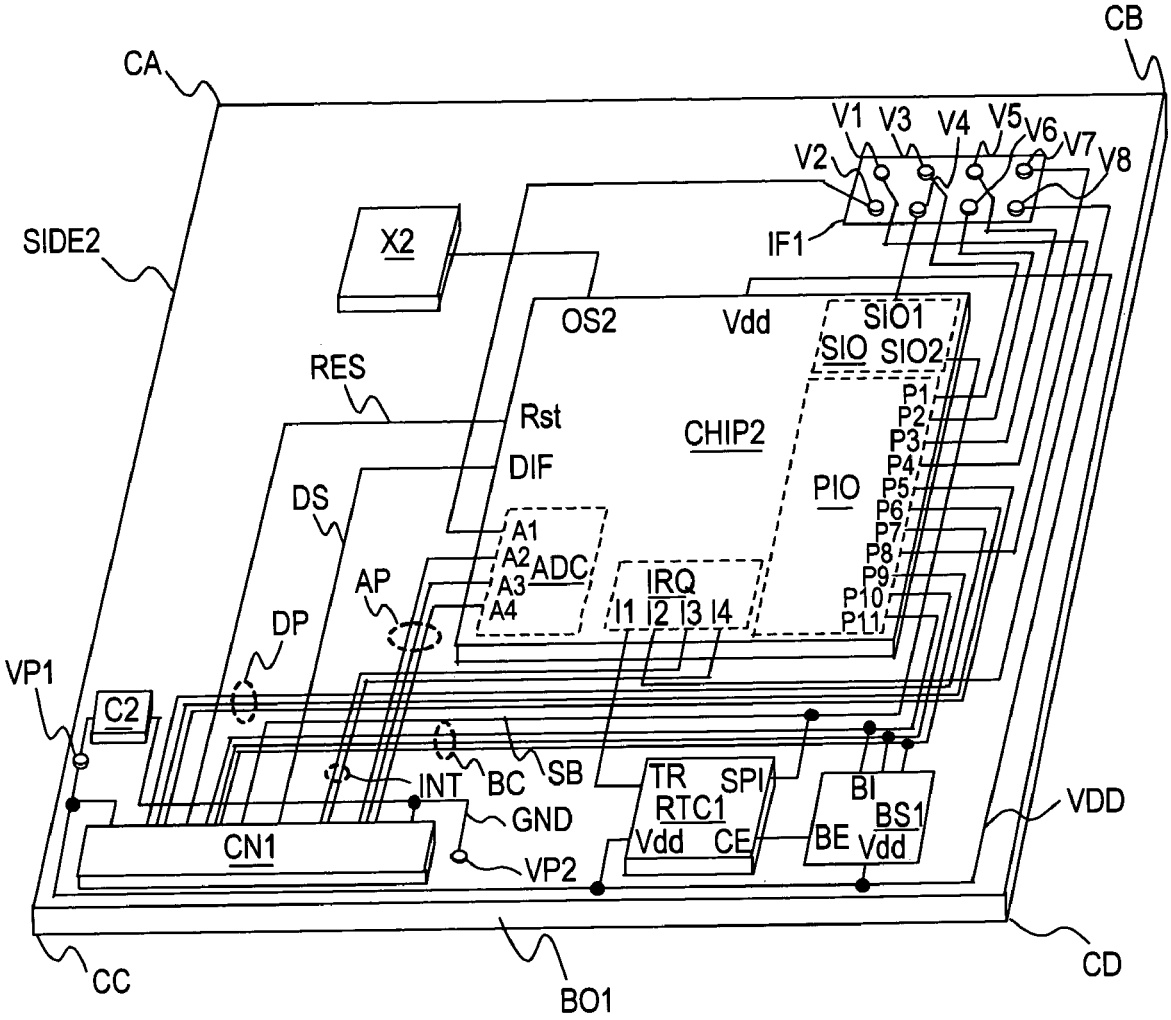
FIG. 7 is a structural diagram of a second surface (SIDE2) of the main board BO1 constituting the wristband sensor node.
Figure 8:
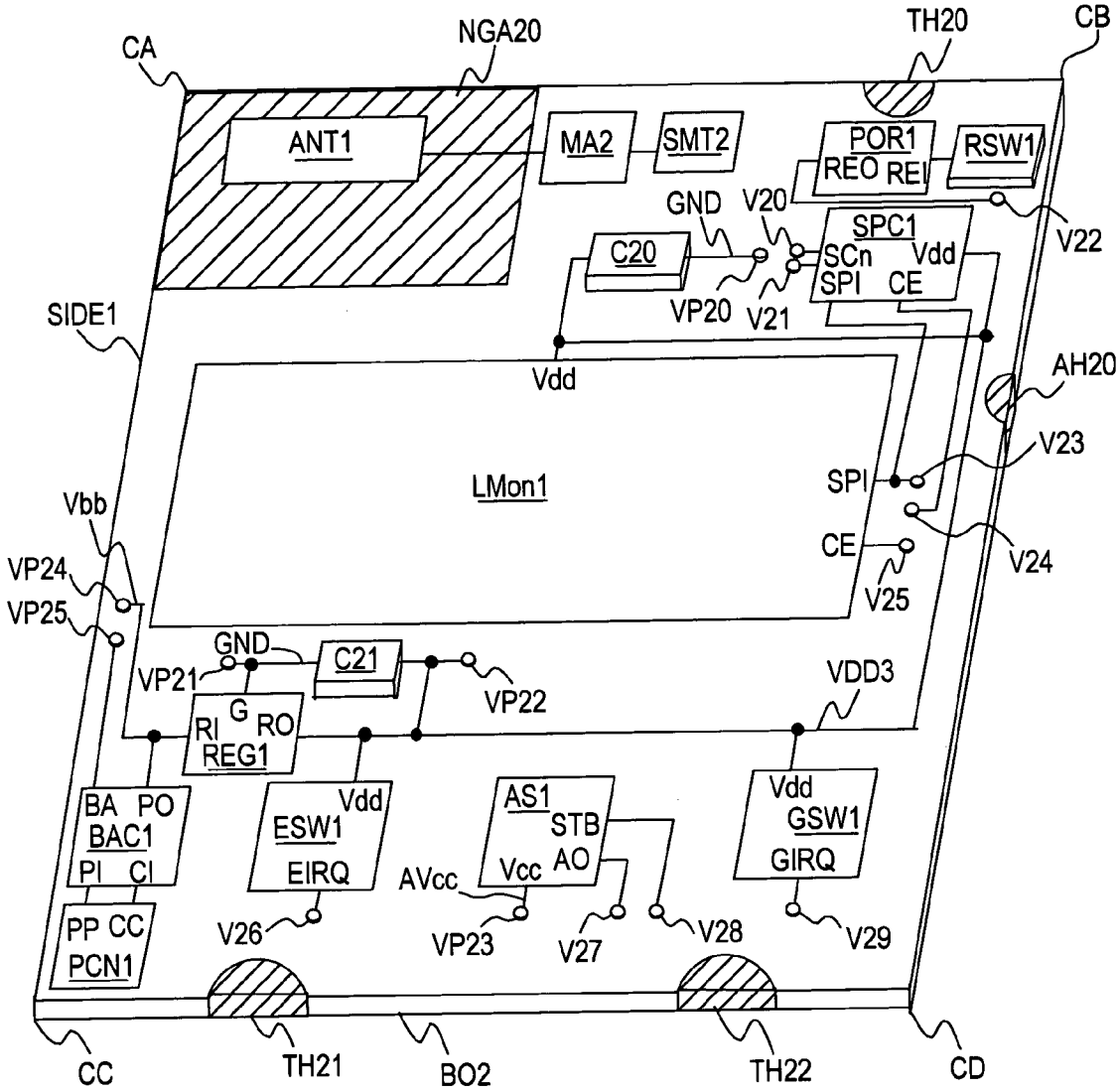
FIG. 8 is a structural diagram of a first surface (SIDE1) of a motherboard BO2 constituting the wristband sensor node.
Figure 9:
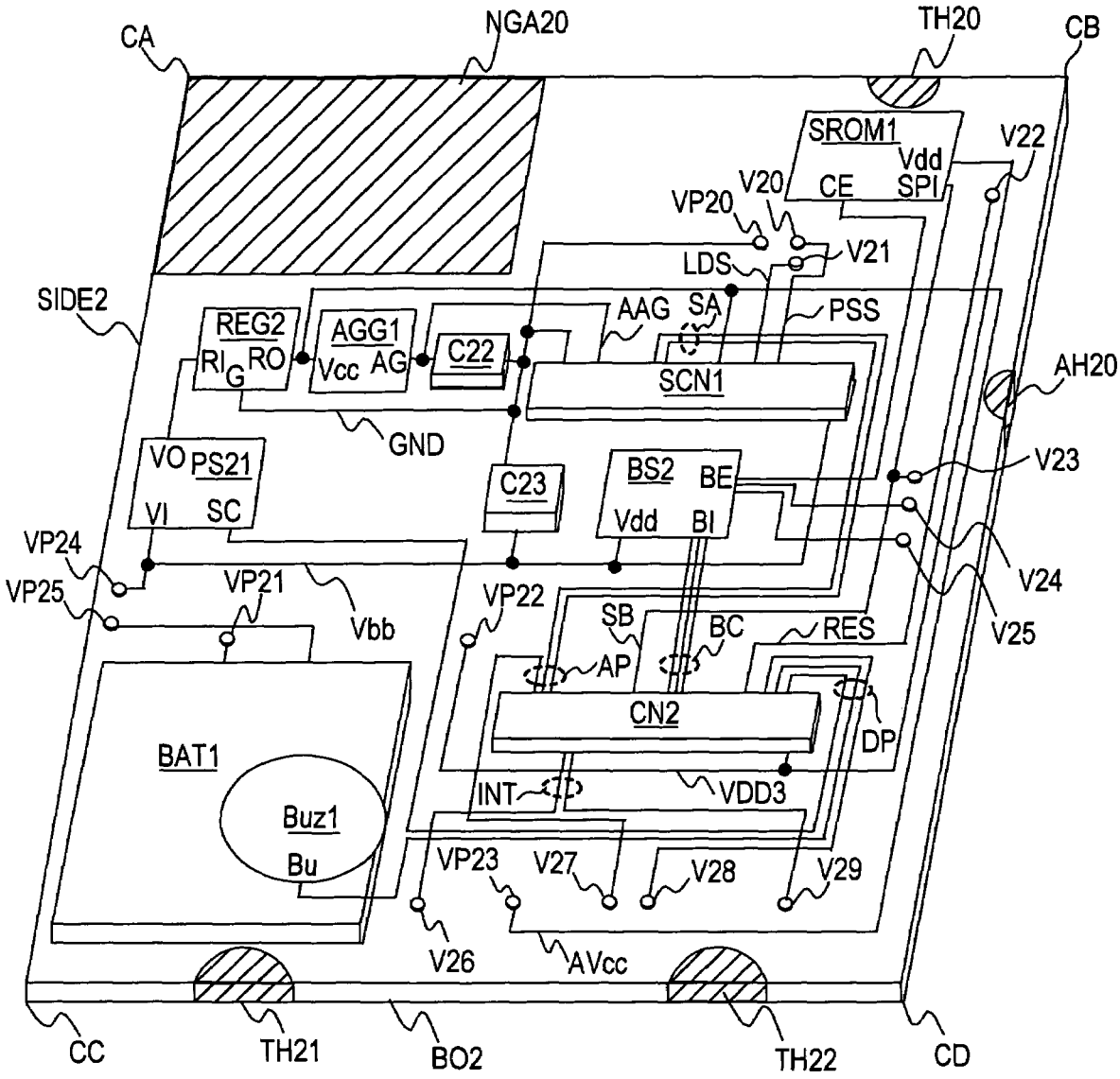
FIG. 9 is a structural diagram of a second surface (SIDE2) of the motherboard BO2 constituting the wristband sensor node.
Figure 10:
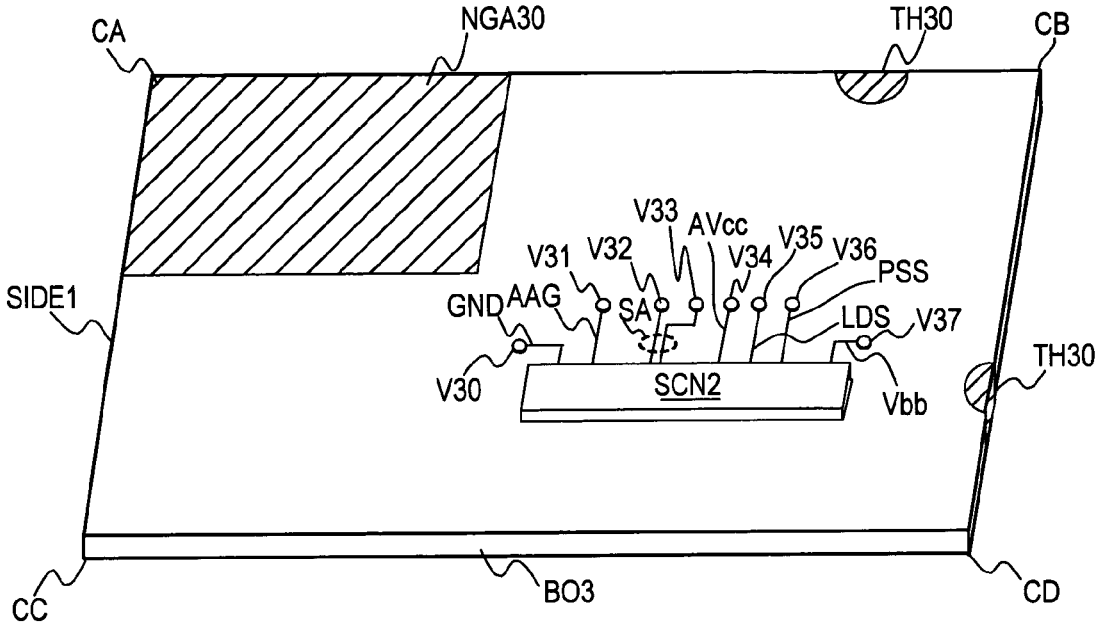
FIG. 10 is a structural diagram of a first side (SIDE1) of a pulsebeat sensor board BO3 constituting the wristband sensor node.
Figure 11:
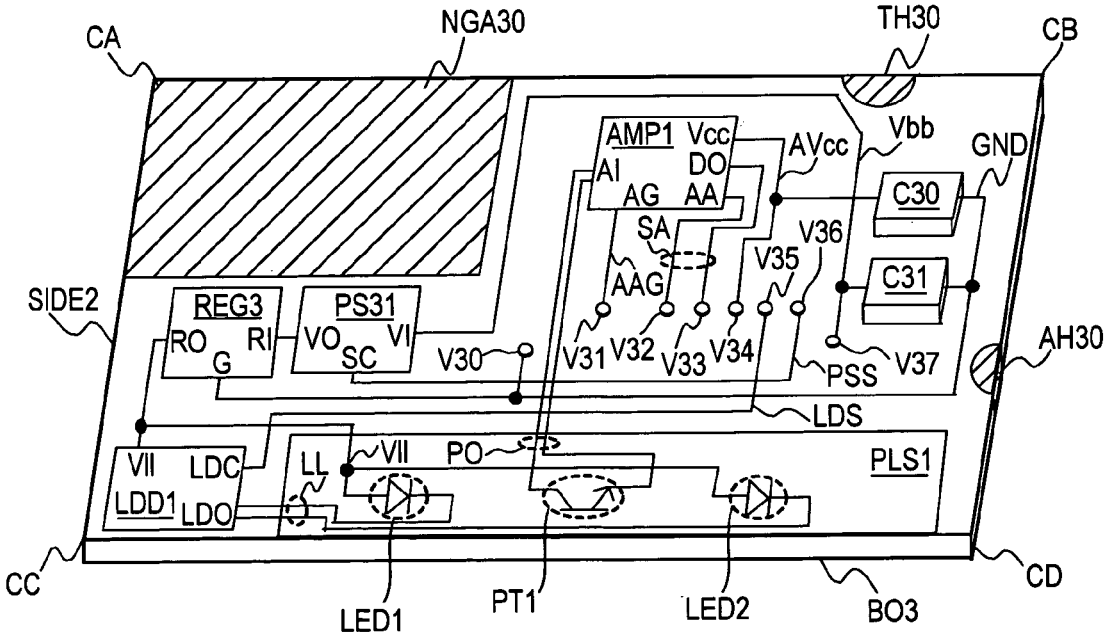
FIG. 11 is a structural diagram of a second side (SIDE2) of the pulsebeat sensor board BO3 constituting the wristband sensor node.
Figure 12:
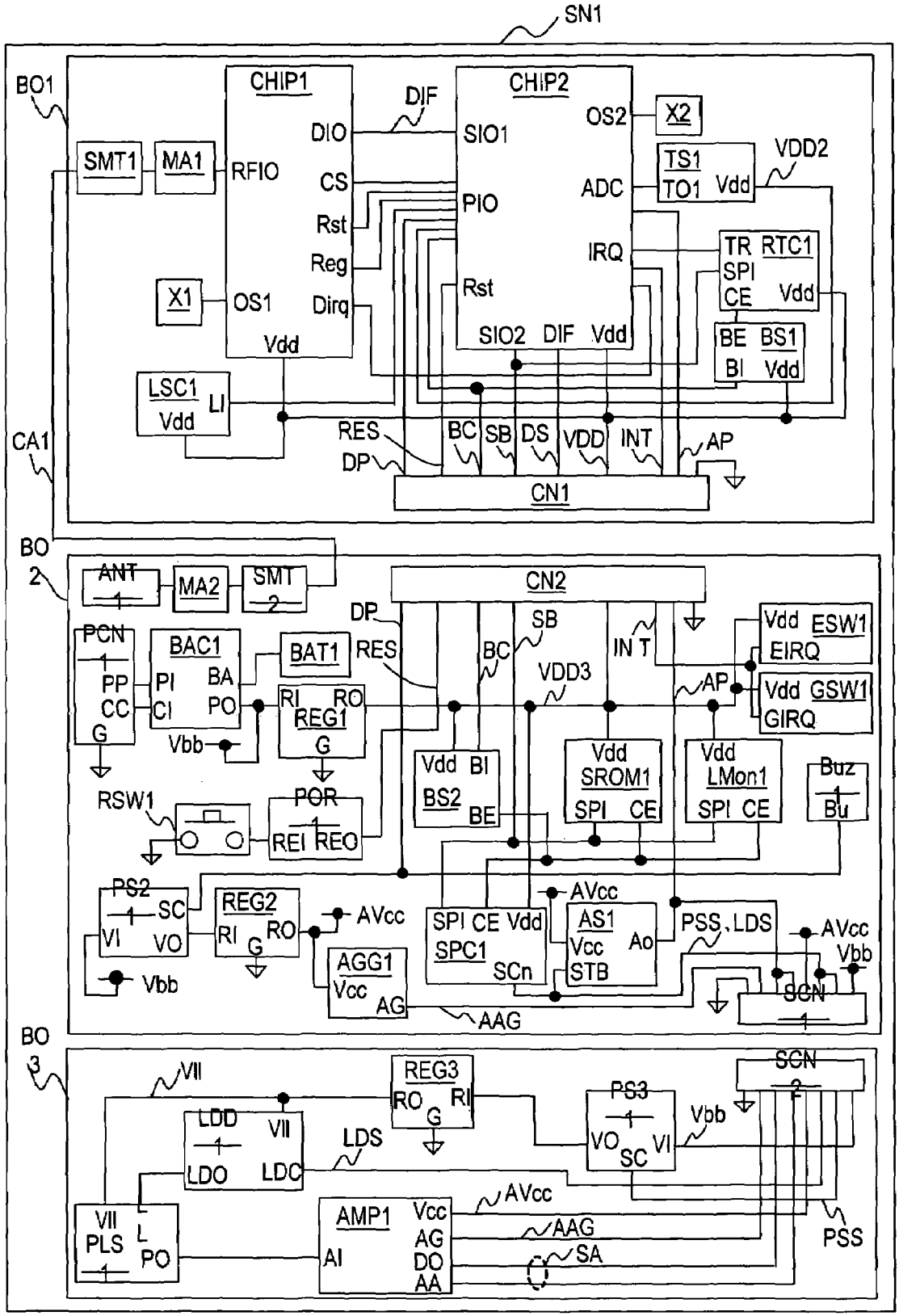
FIG. 12 is a structural diagram showing configurations of the main board BO1, the motherboard BO2, and the pulsebeat sensor board BO3 constituting the wristband sensor node, and a connection relationship among boards.

FIG. 6 shows one principal plane SIDE1 of the board BO1 among three boards constituting the wristband sensor node SN1 of this invention. FIG. 7 shows the other principal plane SIDE2 opposite to the SIDE1 of the board BO1. Similarly, FIG. 8 shows a first principal plane SIDE1 of the motherboard BO2 constituting the wristband sensor node SN1 of this invention, and FIG. 9 shows a second principal plane SIDE2 of the board BO2. Furthermore, FIG. 10 shows a first principal plane SIDE1 of the board BO3 constituting the wristband sensor node SN1 of this invention, and FIG. 11 shows a second principal plane SIDE2 of the board BO3. Those three boards are connected to each other via connectors (CN1, CN2, SCN1, SCN2) and an antenna connection cable CA1, described later, as shown in FIG. 12. Then, the outline of the shape of those three boards BO1 to BO3, and the outline of the positional relationship of connectors are as shown in FIG. 5.

First, referring to FIGS. 6 and 7, the configuration of the board BO1 (hereinafter, referred to as a "main board BO1") will be described. In FIG. 6, on the first principal plane SIDE1 of the main board BO1, a first radio-communications semiconductor integrated circuit chip (CHIP1, hereinafter abbreviated as an "RF chip") is placed on the right side. In an upper portion of the RF chip, a first quartz oscillator X1 for supplying a clock to the RF chip and a temperature sensor TS1 for measuring the temperature of a wearer and the ambient temperature are placed. The temperature sensor TS1 is connected to a signal interface IF1 (described later).

On the left side of FIG. 6, an antenna connector SMT1 and a matching circuit MA1 connected to the antenna connector SMT1 are placed. The matching circuit MA1 is connected to a RF interface RFIO of the RF chip.

On the upper-right side of FIG. 6, through holes (V1, V2, V3, V4, V5, V6, V7, V8) for passing interface signal lines between the first principal plane SIDE1 and the second principal plane SIDE2 and the signal interface IF1 composed of those signal lines are provided, and through holes VP1, VP2 for connecting power supply and grounds of the first principal plane SIDE1 and the second principal plane SIDE2 are placed. Furthermore, at a predetermined position of the principal plane SIDE1, an LED display unit LSC1 and a decoupling capacitor C1 of a power supply line are placed.

On the second principal plane SIDE2 of the main board BO1, as shown in FIG. 7, a second microprocessor chip CHIP2 (hereinafter, referred to as a "microprocessor chip") placed substantially at the center, and a second quartz oscillator X2 for supplying a clock to the microprocessor chip are provided.

On the upper-right side of the second principal plane SIDE2, the signal interface IF1 with respect to the first principal plane SIDE1 is placed so as to perform communication between the front and reverse surfaces of the board BO1.

Furthermore, in the lower portion of the microprocessor chip, a real-time clock circuit RTC1 connected to IRQ1 and a first serial-bus control circuit BS1 for controlling the connection with respect to the microprocessor chip CHIP2 are placed.

On the lower-left side of FIG. 7, a connector CN1 with respect to the second board BO2 is placed, and a power supply bypass capacitor C2 of a power supply circuit is placed in an upper portion of the connector CN1.

FIG. 7 is a perspective view seen from the reverse side (the first principal plane SIDE1 in FIG. 6) of the second principal plane SIDE2.

Therefore, when the main board BO1 is seen from the second principal plane SIDE2, components are placed actually in a bilaterally symmetrical manner with respect to FIG. 7. In this specification, the following figures are also displayed in the same manner.

On the microprocessor chip, in addition to a random access memory, and a non-volatile memory for storing a program, a programmable input/output circuit PIO that can be controlled with a mounted program, an AD conversion circuit ADC capable of converting an analog signal into a digital signal that can be operated inside the microprocessor chip, serial interface circuits (SIO1, SIO2) capable of exchanging digital data with the outside by transmitting a signal through a serial line, an external interrupt circuit IRQ for realizing interruption of a program with a signal from the outside, a program rewritable interface DIF, and the like are integrated in one chip.

Furthermore, in the RF chip, an oscillator for generating a radio carrier, a modulation-and-demodulation circuit for converting a digital signal from the microprocessor chip into a radio signal, a radio circuit, and the like are integrated in one chip. The microprocessor chip is operated with a clock signal generated by the quartz oscillator X2. Similarly, the RF chip is operated with a clock signal generated by the quartz oscillator X1.

Next, referring to FIGS. 8 and 9, the configuration of the motherboard BO2 will be described. In FIG. 8, in the upper portion of the first principal plane SIDE1 of the motherboard BO2, an antenna ANT1 placed on the upper-left side of FIG. 8 of the motherboard BO2, a no ground/power-plane area NGA20 represented by a shaded rectangular area in FIG. 8, which is placed so as to surround the antenna ANT1 and does not have a conductive pattern of a power supply and a ground, a matching circuit MA2 placed at a position adjacent to the right side of the no ground/power-plane area NGA20, an antenna connector SMT2 connected to the matching circuit MA2, a power-on reset circuit POR1 connected to a reset switch RSW1 placed on the upper-right side of the motherboard BO2, and a serial-parallel conversion circuit SPC1 placed in the lower portion of the power-on reset circuit POR1 so as to be connected to the display unit LMon1 are placed. The no ground/power-plane area NGA20 prohibits the formation of a power supply and ground area on the front surface, reverse surface, and inside of the motherboard BO2 at an attachment position of the antenna ANT1 and in the peripheral region of the antenna ANT1. In other words, in the motherboard BO2, a power supply and a ground circuit are formed in a region excluding the no ground/power-plane area NGA20.

At the central position of the principal plane SIDE1 of the motherboard BO2, as shown in FIG. 1, the display unit LMon1 is placed so as to be positioned substantially at the central position on the front surface of the case CASE1. The display unit LMon1 is placed so as not to overlap the no ground/power-plane area NGA20.

In the lower portion of the display unit LMon1 placed at the center of the principal plane SIDE1 of the motherboard BO2, a regulator REG1 for supplying a power to the motherboard BO2, a charge control circuit BAC1 for controlling a charge power to the battery BAT1, and a charge terminal PCN1 for connection to an external power supply are placed on the lower-left side of FIG. 8.

At the substantially central position of the principal plane SIDE1 between the display unit LMon1 and the lower end of the motherboard BO2, the above-mentioned emergency switch ESW1, an acceleration sensor AS1 for measuring the acceleration applied to the sensor node SN1, and the above-mentioned measurement switch GSW1 are provided. The acceleration sensor AS1 is placed between the emergency switch ESW1 and the measurement switch GSW1.

At a predetermined position on the periphery of the motherboard BO2, case attachment holes (TH20, TH21, TH22) and an antenna cable through hole AH20 are formed, and the motherboard BO2 is attached to the case CASE1 through the attachment holes TH20 to TH22.

Furthermore, at a predetermined position of the motherboard BO2, through holes (V20, V21, V22, V23, V24, V25, V26, V27, V28, V29) for passing interface signal lines between the first principal plane SIDE1 and the second principal plane SIDE2 are formed. Furthermore, through holes (VP20, VP21, VP22, VP23, VP24, VP25) for connecting power supply and grounds of the first principal plane SIDE1 and the second principal plane SIDE2, and decoupling capacitors C20, C21 are placed at a predetermined position.

Next, FIG. 9 shows the second principal plane SIDE2 of the motherboard BO2. In FIG. 9, on the upper-left side of FIG. 9 of the motherboard BO2, the no ground/power-plane area NGA20 that does not have a circuit pattern of a power supply and a ground circuit is formed. On the lower-left side of FIG. 9 of the motherboard BO2, the battery BAT1 is attached. The battery BAT1 can be composed of, for example, a chargeable secondary battery or the like.

Furthermore, at a predetermined position of the second principal plane SIDE2 of the motherboard BO2, a non-volatile memory SROM1 for storing data and the like, a regulator REG2 for supplying a power onto the motherboard BO2, an analog reference voltage circuit GG1, fed by to the regulator REG2, for generating a reference voltage, a connector SCN1 connected to the board BO3, a power-off switch PS21 for controlling a power to the regulator REG2, a serial-bus control circuit BS2 connected to the connector CN2 with respect to the main board BO1, a buzzer Buz1 connected to the connector CN2 with respect to the main board BO1 so as to overlap the battery BAT1, and power supply bypass capacitors C22, C23 are placed.

In order to allow stable radio-communication when the user (wearer) wears the wristband sensor node SN1 of this invention on the arm, the wristband sensor node of this invention is characterized by adopting the following peculiar component arrangement. More specifically, the antenna ANT1 is set at a position farthest from the human body during wearing, i.e., on the CA-CB line corresponding to the upper side of FIG. 8. Furthermore, the no ground/power-plane area NGA20 that does not have a circuit pattern of a power supply and a ground circuit is placed on the periphery of the antenna ANT1.

Next, referring to FIGS. 10 and 11, the configuration of the board BO3 (hereinafter, referred to as a "pulsebeat sensor board BO3", attached to the upper portion on the back surface of the motherboard BO2 will be described.

In FIG. 10, the first principal plane SIDE1 of the pulsebeat sensor board BO3 has a no ground/power-plane area NGA30 that does not have a circuit pattern of a power supply and a ground circuit in a predetermined region on the upper-left side of FIG. 10. As shown in FIG. 5E, the pulsebeat sensor board BO3 overlaps the no ground/power-plane area NGA20 of the motherboard BO2, to which the antenna ANT1 is attached, so that an area opposed to the no ground/power-plane area NGA20 of the motherboard BO2, which corresponds to the no ground/power-plane area NGA30, is set so as not to have a circuit pattern similarly.

On the lower-right side of FIG. 10 of the first principal plane SIDE1 of the pulsebeat sensor board BO3, a connector SCN2 for connection with the motherboard BO2 is placed. In the upper portion of the connector SCN2, through holes V30, V31, V32, V33, V34, V35, V36, V37 for connecting interface signal lines and power supply/ground lines of the first principal plane SIDE1 and the second principal plane SIDE2 are placed.

At a predetermined position on the periphery of the pulsebeat sensor board BO3, case attachment holes TH30 and an antenna cable penetration hole AH30 are formed.

Next, FIG. 11 shows the second principal plane SIDE2 of the pulsebeat sensor board BO3. On the second principal plane SIDE2, a no ground/power-plane area is placed on the upper-left side of FIG. 11 so as to correspond to the no ground/power-plane area NGA30 of the principal plane SIDE1.

At the lower end of the second principal plane SIDE2 of the pulsebeat sensor board BO3, a pulsebeat sensor head circuit PLS1, in which an infrared light-emitting diode LED1, a phototransistor PT1, and an infrared light-emitting diode LED2 are formed in the horizontal direction in FIG. 11, is placed to constitute a pulsebeat sensor. On the lower-left side of FIG. 11 of the second principal plane SIDE2 of the pulsebeat sensor board BO3, a pulsebeat sensor LED-light strength control circuit LDD1 for controlling a power to the infrared light-emitting diodes LED1 and LED2, a regulator REG3 for controlling a power to the pulsebeat sensor LED-light strength control circuit LDD1, and a power-off switch PS31 for controlling the on/off of a power supply to the regulator REG3 are placed.

In a region on the right side of FIG. 11 of the principal plane SIDE2, a pulsebeat-signal amplifier AMP1 for amplifying the output from the phototransistor PT1 is placed. The output and the like of the pulsebeat-signal amplifier AMP1 are connected to the through holes V31 to V34 among the through holes V30, V31, V32, V33, V34, V35, V36, V37 for connecting the interface signal lines and power supply/ground lines between the first principal plane SIDE1 and the second principal plane SIDE2.

Furthermore, the case attachment hole TH30 and the antenna cable penetration hole AH30 are placed in the same way as in the principal plane SIDE1.

Furthermore, at a predetermined position on the pulsebeat sensor board BO3, power supply bypass capacitors C30, C31 are placed.

This invention is characterized in that an area opposed to the no ground/power-plane area NGA20 placed on the motherboard BO2 is set so as not to have a circuit pattern, as the no ground/power-plane area NGA30 of the pulsebeat sensor board BO3. As a result, when the user (wearer) US1 wears the wristband sensor node SN1 on the arm, stable radio-communication can be realized.

FIG. 12 shows an entire configuration of the board unit of the wristband sensor node SN1 of this invention. As described above, the wristband sensor node SN1 of this invention is composed of the main board BO1, the motherboard BO2, and the pulsebeat sensor board BO3. Among them, the main board BO1 and the motherboard BO2 are connected via the connectors CN1 and CN2.

Furthermore, the motherboard BO2 and the pulsebeat sensor board BO3 are connected via the pulsebeat sensor connectors SCN1 and SCN2. Furthermore, the antenna connection terminal SMT1 of the main board BO1 and the antenna connection terminal SMT2 of the motherboard BO2 are connected via the antenna connection cable CA1. As a result, radio-communication using the antenna ANT1 on the motherboard can be realized.

The connectors CN1 and CN2 are respectively composed of a microprocessor chip digital signal line DP, a microprocessor chip reset signal line RES, a microprocessor serial-bus control signal line BC, a microprocessor chip serial-bus signal line SB, a microprocessor chip program rewritable signal line DS, a microprocessor chip external-interrupt signal line INT, a microprocessor chip analog signal line AP, a power supply line VDD, and a ground line GND. Among those signal lines, the digital signal line DP and the serial-bus control signal line BC are connected to a programmable input/output circuit PIO of the microprocessor chip CHIP2, and can be controlled with a program mounted on a microprocessor chip. As described later, the program mounted on the microprocessor chip is used for realizing the operation specific to the wristband sensor node of this invention.

The serial-bus signal line SB is connected to a second serial interface SIO2 mounted on the microprocessor chip. As descried later, by controlling a serial-bus selection circuit BS1 mounted on the main board BO1 and the second serial-bus selection circuit BS2 mounted on the motherboard BO2, data can be exchanged in a so-called bus form with the real-time clock circuit RTC1 mounted on the main board BO1, the non-volatile memory SROM1 mounted on the motherboard BO2, the display unit LMon1, and the serial-parallel conversion circuit SPC1 via the serial-bus control signal line BC.

The reset signal line RES is controlled by a power-on reset circuit POR1 mounted on the motherboard BO2. Owing to the power-on reset circuit, the reset operation of the microprocessor chip during power-on is realized. Owing to the manual reset switch RSW1 mounted on the motherboard BO2, if required, a reset signal can be generated, and the operation can be reset manually in a forceful manner during the operation of a program.

The analog signal line AP of the main board BO1 is connected to the acceleration sensor AS1 mounted on the motherboard BO2, and is connected to the pulsebeat-signal amplifier AMP1 mounted on the pulsebeat sensor board BO3 via the pulsebeat sensor connectors SCN1 and SCN2. The output voltage values of the acceleration sensor and the pulsebeat sensor can be read using the AD conversion, circuit ADC contained in the microprocessor chip via the analog signal line AP. As described later, owing to the sensing control program specific to the wristband sensor node SN1 of this invention, those two kinds of sensors are combined to realize a pulsebeat sensing operation with a low power consumption.

The external-interrupt signal line INT is connected to the emergency switch ESW1 and the measurement switch GSW1 mounted on the motherboard BO2. By pressing those switches, an interrupt request can be generated with respect to the microprocessor chip. As described later, by using the wristband sensor node of this invention in combination with an emergency call program specific thereto, the power consumption can be suppressed to a level substantially equal to that of a standby state without degrading the response performance of an emergency call, i.e., the response time.

The rewrite signal DS is used for rewriting the program mounted on the microprocessor chip. The rewrite signal DS is combined with a board having an appropriate interface and a program development tool to provide debug and a rewrite environment of the program mounted on the microprocessor chip. The development environment, the rewrite environment, and the like will not be particularly described here.

The connectors SCN1 and SCN2 for connecting the motherboard BO2 and the pulsebeat sensor board BO3 are composed of power supply lines $V_{bb}$, $AV_{cc}$, man analog reference voltage line AAG1, a ground line GND, a pulsebeat sensor LED-light strength control signal line LDS, a pulsebeat sensor LED power supply interrupt control signal line PSS, and a pulsebeat sensor signal line SAA.

The analog reference voltage line AAG1 is generated by the analog reference potential voltage circuit AGG1 mounted on the motherboard BO2. The analog reference voltage line AAG1 is used as a reference voltage for the pulsebeat sensor light-receiving phototransistor PT1 in the pulsebeat sensor head circuit PLS1 mounted on the pulsebeat sensor board BO3 and in the pulsebeat-signal amplifier AMP1.

The pulsebeat sensor LED-light strength control signal line LDS is connected to the pulsebeat sensor LED-light strength control circuit LDD1 mounted on the pulsebeat sensor board BO3. The serial-parallel conversion circuit SPC1 mounted on the motherboard BO2 can control the control signal line from the microprocessor chip via a serial-bus SB. By controlling the signal line, the light strength of infrared light of the infrared light-emitting diodes LED1, LED2 can be controlled with the program mounted on the microprocessor chip. In the wristband sensor node SN1 of this invention, by combining the pulsebeat sensing control program specific to this invention and the control signal line, stable pulsebeat sensing can be realized while the power consumption is suppressed.

The pulsebeat sensor LED power supply interrupt control signal line PSS is controlled by the microprocessor chip via the serial-bus SB by the serial-parallel conversion circuit SPC1 mounted on the motherboard BO2 in the same way as in the pulsebeat sensor LED-light strength control signal line LDS. The control signal line is inactivated by program mounted on the microprocessor chip. As a result, the supply of a current to the infrared light-emitting diodes LED1, LED2 can be interrupted. In combination with the pulsebeat sensing control program specific to this invention, the consumption current while the pulsebeat sensor is not being used can be minimized.

The pulsebeat sensor signal line SAA is input to the AD conversion circuit ADC contained in the microprocessor chip via the connectors CN1 and CN2. A signal from the pulsebeat sensor can be taken in the microprocessor chip via the signal line SAA. As described later, in combination with the pulsebeat sensing control program specific to this invention, a pulsebeat signal can be obtained stably with a low power consumption.

<Operation of Each Board>

The configuration of the wristband sensor node SN1 of this invention has been described above. Hereinafter, the operation of each board will be described successively from the main board BO1.

In FIGS. 6 and 7, the main board BO1 is composed of the RF chip CHIP1 and the microprocessor chip CHIP2. Those two chips are connected to each other via the signal interface IF1. The microprocessor chip controls the temperature sensor TS1 mounted on the main board and the pulsebeat sensor mounted on the pulsebeat sensor board BO3 to obtain sensor data.

Furthermore, the microprocessor chip controls the RF chip CHIP1 via the signal interface IF1 to transmit/receive sensor data. The RF chip CHIP1 converts sensor data transmitted from the microprocessor chip CHIP2 into a radio signal in an appropriate system, and transmits it to a radio terminal set at the basestation BS10 (see FIG. 3) via the antenna ANT1 by radio.

Furthermore, if required, the RF chip CHIP1 receives a radio signal from the basestation BS10 via the antenna ANT1. The basestation BS10 typically transmits a sensing period (sensing frequency) of sensor data, operation parameters such as a radio frequency and a transmission rate used for radio-communication, a message displayed on the display unit LMon1 mounted on the wristband sensor node SN1 as described later, and the like.

The radio signal transmitted from the basestation BS10 is converted into digital data that can be dealt with by the microprocessor chip CHIP2 in the RF chip CHIP1, and given to the microprocessor chip CHIP2 via the signal interface IF1. The microprocessor chip CHIP1 analyzes the contents of the digital data from the basestation BS10 and executes required processing. For example, when the microprocessor chip CHIP2 receives an operation parameter, this parameter is reflected on setting during the subsequent radio-communication and sensor driving. Furthermore, when the microprocessor chip CHIP2 receives a display message, the microprocessor chip CHIP2 controls a serial interface to allow the display unit LMon1 mounted on the motherboard BO2 to display a required message. As described later, in the wristband sensor node SN1 of this invention, if a program to be mounted on the microprocessor chip is set appropriately, not only sensor information such as a pulsebeat and a temperature, but also other data can be transmitted to the basestation BS10. For example, when the physical condition of the user US1 wearing the wristband sensor node SN1 is disturbed suddenly, the user US1 can also send an emergency call to the basestation BS10 by radio-communication by pressing the emergency switch ESW1.

The signal interface IF1 (see FIGS. 6 and 7) is composed of an RF chip data signal line DIO, an RF chip selection signal line CS, an RF chip reset signal line $R_{st}$, an RF chip power supply control signal line $R_{eg}$, and an RF chip data interrupt signal line $D_{irq}$. Among those signal lines, the RF chip data signal line DIO is connected to a first serial interface SIO1 of the microprocessor chip, and is used for transmitting sensor data and receiving an operation parameter/display message and the like. Furthermore, the RF chip selection signal line CS is controlled by the programmable data input/output circuit PIO of the microprocessor chip, and is activated only in the case of radio transmission/reception. Similarly, the RF chip power supply control signal line $R_{eg}$ is used for the purpose of turning on/off a power supply of the RF chip and is controlled by the programmable input/output circuit PIO of the microprocessor chip. Furthermore, the RF chip reset signal line $R_{st}$ is a control signal line for setting respective circuit blocks inside the RF chip in an initial state after power-on of the RF chip to allow them to perform predetermined operations. In the same way as in the RF chip power supply control signal line $R_{eg}$, the RF chip reset signal line $R_{st}$ is controlled by the programmable input/output circuit PIO of the microprocessor chip.

The RF chip data interrupt signal line $D_{irq}$ is used for requesting the microprocessor chip to perform appropriate processing from the RF chip when the RF chip has completed the transmission preparation of data, the data received from the basestation is present in the RF chip, or the like. Therefore, the RF chip data interrupt signal line $D_{irq}$ is connected to the external interrupt circuit IRQ. The above configuration regarding the signal lines is shown merely for an illustrative purpose, and may be varied appropriately depending upon the kind of the RF chip and the microprocessor chip to be used. However, this will not influence the nature of this invention.

Figure 13:
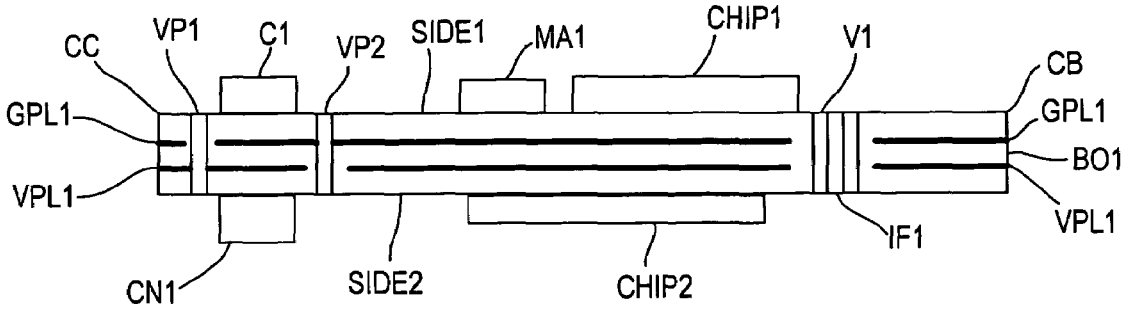
FIG. 13 is a cross-sectional view of the main board BO1.

FIG. 13 is a cross-sectional view of the main board BO1. As shown in FIG. 13, a first ground plane GPL1 and a first power supply plane VPL1 are set in the main board BO1. The ground plane GPL1 is connected to a signal line (e.g., VP2) connected to a ground level inside the board, and fixed at the ground potential. Furthermore, the power supply plane VPL1 is similarly connected to a signal line (e.g., VP1) connected to a power supply line VDD so as to be fixed to the power supply line VDD. In the wristband sensor node of this invention, those two conductive plane layers are used as a shield between two principal planes SIDE1 and SIDE2 of the main board BO1. Usually, the noise generated in a digital circuit such as the microprocessor chip mounted on the principal plane SIDE2 enters the RF chip mounted on the principal plane SIDE1 to adversely influence the receiving sensitivity. However, when a conductive layer connected to the ground level or the power supply level is buried in the board, a noise component can be reduced because of their shield effect. Consequently, within the limited mounting area, the effective receiving sensitivity of the RF chip is not degraded because the noise can be effectively suppressed. This system is also effective for preventing the noise generated in the digital circuit from being radiated from the antenna as an undesired spurious emission.

<Detailed Operation of Main Board BO1>

Hereinafter, referring to FIGS. 6 and 7, the configuration and the operation of the RF portion of the main board BO1 of this invention will be described. The RF chip is not specific to this invention, so the detail of the internal configuration thereof will not be described particularly. Generally, the RF portion is composed of digital interface portions (DIO, CS, $R_{st}$, $R_{eg}$, $D_{irq}$ in FIG. 6), a high-frequency interface portion RFIO, a clock oscillation portion OS1, and a power supply portion $V_{dd}$.

The digital interface portion exchanges data with the microprocessor chip. As described above, in the RF chip used in the wristband sensor node SN1 of this invention, the following can also be performed: the oscillation circuit OSC is stopped with a control signal from the microprocessor chip to interrupt the power supply of the RF chip. As a result, the entire RF chip is shifted in a standby state. In this case, the consumption current of the RF chip can be reduced to, typically, 1 μA or less.

In the high-frequency interface portion RFIO, a radio communication signal is generated from a carrier signal generated in the RF chip and a data signal from the microprocessor chip, and is transmitted to the antenna ANT1 via the matching circuit MA1. During reception, the radio signal is demodulated in the high-frequency interface from the antenna ANT1 via the matching circuit MA1. Thereafter, the demodulated data signal is transmitted to the microprocessor chip via the digital interface portion DIO. In the clock oscillation portion, a clock required for operating the RF chip is generated from the quartz oscillator X1.

The above description of the RF chip is limited to only a portion required for describing this invention. Actually, various kinds of circuit blocks can be integrated in addition to the above description. However, it should be appreciated that this will not influence the nature of this invention. Hereinafter, the operation and the configuration of other constituent components will be described.

The role of the matching circuit MA1 is as follows. More specifically, the matching circuit MA1 matches the input/output impedance of the RF chip with the input/output impedance of the antenna ANT1 so that a high-frequency radio signal can be transmitted without any loss between those elements. The matching circuit MA1 is basically composed of a passive component such as an inductor/capacitor. This component is not related to the nature of this invention, so it will not be described in detail here.

Next, the digital portion of the main board BO1 will be described. The microprocessor chip CHIP2 that is a main component of the digital portion is composed of a random access memory/non-volatile memory, a processor, a serial interface, an AD conversion circuit, a programmable input/output circuit, an external-interrupt circuit, and the like. Those circuit blocks are connected to one another via interval buses so that they can exchange data and control one another. FIG. 7 shows only portions required for describing this invention. On the non-volatile memory of the microprocessor chip, software (described later) for realizing the control system specific to this invention is mounted. A processor CPU controls other circuit blocks in the microprocessor chip based on the mounted software to realize a desired operation. Furthermore, as described above, the serial interface circuit SIO is used for exchanging data with the RF chip. Furthermore, the serial interface circuit SIO is also used for exchanging data such as RTC. Furthermore, data of a sensor of an analog type is read by the AD conversion circuit ADC. Furthermore, the programmable input/output circuit PIO controls various kinds of signal lines described above to set each block of a circuit of the wristband sensor node of this invention in a desired operating mode.

The temperature sensor TS1 is an analog type sensor, and measures the body temperature of the user (wearer) wearing the wristband sensor node SN1 of this invention or the ambient temperature. The temperature data from the sensor TS1 is converted to a digital data by the AD conversion circuit ADC in FIG. 7, and is stored in a random access memory or a non-volatile memory of the microprocessor chip, if required. To reduce the power consumption by an intermittent operation (described later), in the sensor node SN1 of this invention, PIO/P8 of the microprocessor chip supply a power to the temperature sensor TS1. More specifically, only during the use of the temperature sensor TS1, a parallel signal line P8 in FIG. 7 is set to be "1", a power is supplied to the temperature sensor TS1 to activate the sensor, and the value of the temperature sensor TS1 is read. After reading of the value, PIO/P8 is returned to a "high impedance state", and the supply of a power is interrupted. This suppresses the undesired power consumption of the temperature sensor TS1. The current consumption of the temperature sensor TS1 is typically 5 μA, so the output of the programmable input/output circuit PIO of the microprocessor chip can be used as a power supply of the temperature sensor TS1.

When it is desired that a high-precision type, for example, be used for the temperature sensor TS1, or the like, the current consumption becomes several mA or more. In this case, the following configuration is more preferable: a power supply interrupt switch (described later) is controlled by the programmable input/output circuit PIO of the microprocessor chip to control the power supply to the temperature sensor TS1.

Figure 16A:
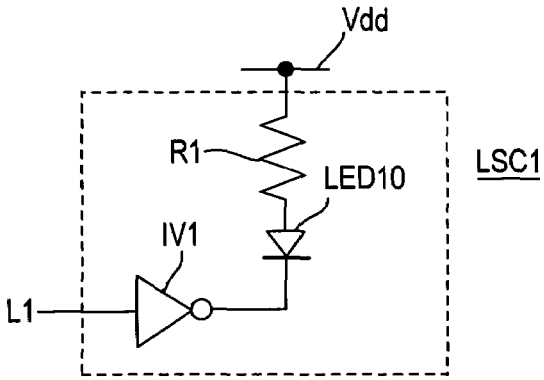
Figure 16B:
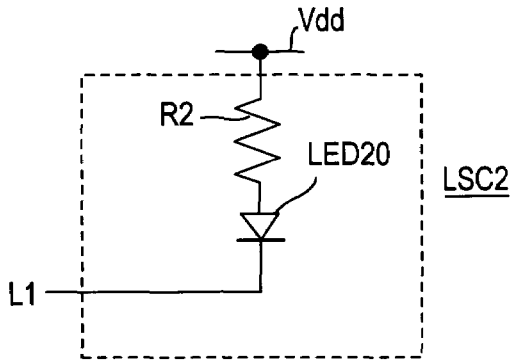

FIGS. 16A and 16B show an example of a configuration of the LED display unit LSC1. Usually, as shown in FIG. 16B, it is sufficient that the LED display unit LSC1 is of the type that is directly driven by the programmable input/output circuit PIO of the microprocessor chip. When it is desired to further increase the light strength of the LED display unit LSC1, or the like, as shown in FIG. 16A, the LED display unit LSC1 of the type that has a current amplified by an inverter IV1 can also be used. The inverter IV1 is used merely for the purpose of amplifying a current. Therefore, for example, other elements capable of amplifying a current, such as a bipolar transistor, a MOS-type transistor, and the like can also be used instead of the inverter.

The real-time clock circuit RTC1 in FIG. 7 is used for the purpose of reducing the current consumption during standby of the microprocessor chip to reduce the power consumption during the intermittent operation. In the intermittent operation, the circuit is activated at a constant interval to perform a predetermined operation, and the circuit is shifted to a standby state immediately after the completion of the operation. As a result, the average power consumption is suppressed.

The above system is a low-power system very preferable for reducing power consumption of the sensor node SN1. For example, in the wristband sensor node SN1 of this invention, unless there is a special situation, sensing at an interval of 5 minutes to one hour is typically sufficient. It is more preferable that during the remaining time, the power supply to an unnecessary part be interrupted to achieve the long life of a battery. For this intermittent operation, a reference time signal such as a timing signal, i.e., a time interval of sensing is necessary. In general, this timing signal is generated by the microprocessor chip mounted on the sensor node SN1. However, in order to allow the microprocessor chip to generate a timing signal, it is necessary that the microprocessor chip continues to operate at a clock X2. In the case of the current semiconductor technology, typically, when a timing signal is generated by the microprocessor chip, a current of about 10 μA is consumed. Therefore, the wristband sensor node SN1 of this invention adopts a system in which the dedicated real-time clock circuit RTC1 with a low power consumption is attached externally, and a timing signal is generated by the real-time clock circuit RTC1. As the dedicated real-time clock module, even in the current semiconductor technology, the one with a current consumption of about 0.5 μA is available. Furthermore, it is not necessary that the microprocessor chip generates a timing signal for the intermittent operation, so the clock X2 can be stopped. In other words, the microprocessor chip can be shifted to an operating mode with a lower power consumption. Typically, the contents of a register and a random access memory in the microprocessor chip can be ensured, and even in a so-called software-standby mode, the current consumption can be suppressed to 1 μA or less. In other words, the power consumption can be reduced to one tenth compared with the case where a timing signal is generated by the microprocessor chip.

According to the system in which a timing signal for the intermittent operation is generated by the real-time clock circuit RTC1, it is necessary to allow the microprocessor chip to recover from the software-standby mode with the timing signal from the real-time clock circuit RTC1. Furthermore, in order to satisfy an operation parameter change request from the basestation and the like, it is necessary that the intermittent operation interval and the like can be changed. For this purpose, in the wristband sensor node SN1 of this invention, the timer output of the real-time clock circuit RTC1 is connected to an input terminal I1 of the external interrupt circuit IRQ. This enables the microprocessor chip to recover from the software-standby mode by an RTC interrupt. If an appropriate program is mounted on the microprocessor chip, the sensing by the intermittent operation can be realized. Furthermore, by connecting the real-time clock circuit RTC1 to the serial-bus signal line SB, the timing signal interval and the like of the real-time clock circuit RTC1 can be changed.

Various devices in addition to the real-time clock circuit RTC1 are connected to the serial-bus signal line SB in FIG. 7. For example, the display unit LMon1 mounted on the motherboard BO2, the non-volatile memory SROM1, and the like are connected to the serial-bus signal line SB in a so-called bus form. Therefore, it is necessary to exclusively control a serial bus between those devices. In order to achieve this object, in the wristband sensor node SN1 of this invention, serial-bus control circuits BS1, BS2 are mounted.

Figure 17:
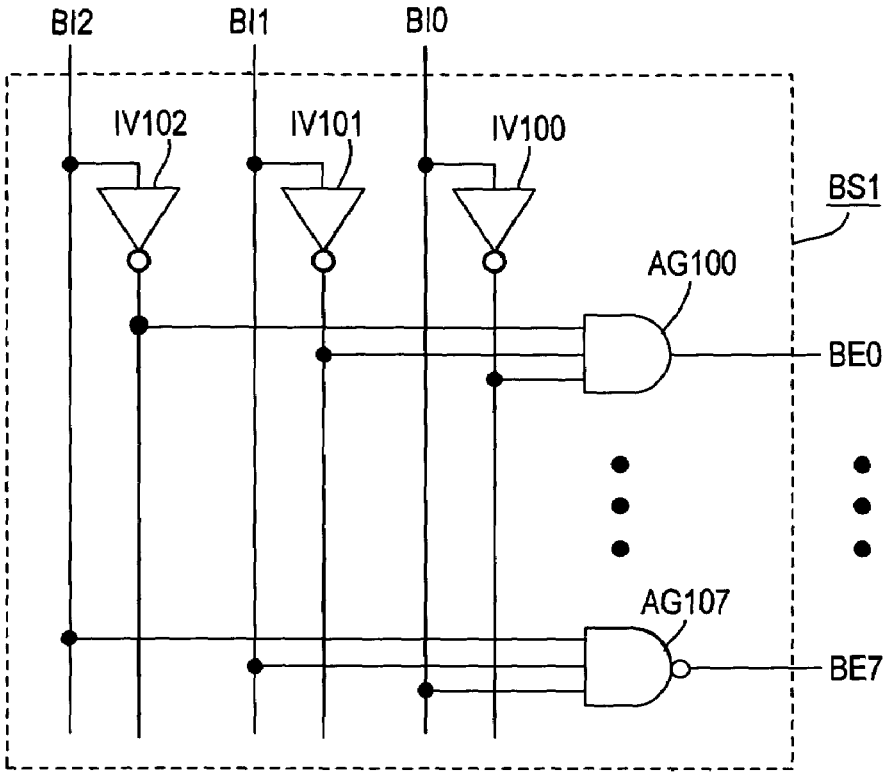
FIG. 17 is a circuit diagram showing an example of bus selectors (BS1, BS2) used in the wristband sensor node.

FIG. 17 shows an exemplary configuration of the above-mentioned serial-bus control circuit. Input terminals BI0 to BI2 of the serial-bus control circuit BS1 are connected to the serial-bus control signal line BC, and controlled by the programmable input/output circuit PIO (P9, P10, P11) mounted on the microprocessor chip. A logic signal from the input terminals is decoded with 8 bits of logic gates AG100 to AG107. For example, only in the case of BI0, BI1, BI2="0", "0", "0", a BE0 output becomes "1", which can be used as an activating signal of a device that is activated with a positive logic. Furthermore, in the case of a device that is activated with a negative logic, for example, a logic gate of the type represented by AG107 may be used. According to this system, the serial-bus control circuit BS1 shown in FIG. 17 can exclusively select each device to be connected to the serial-bus signal line SB. The logic circuit shown in FIG. 17 is merely shown for an illustrative purpose. Actually, circuit configurations of various forms can be used.

The main board BO1 has been described above. Hereinafter, the motherboard BO2 will be described.

<Detail of Motherboard BO2>

Referring to FIGS. 8 and 9, the most characteristic points of the motherboard BO2 are the antenna ANT1 placed close to the CA-CB line corresponding to the upper side in those figures, and the no ground/power-plane area NGA20 placed on the periphery of the antenna ANT1, for the purpose of obtaining satisfactory sensitivity. Those components are arranged so that the antenna ANT1 is placed at a position farthest from the human body, i.e., on the CA-CB line side when the sensor node SN1 is worn on the arm, as described above. Furthermore, by setting the no ground/power-plane area NGA20 on the periphery of the antenna ANT1, stable communication with satisfactory sensitivity can be realized.

Hereinafter, other circuit blocks of the motherboard BO2 will be described.

First, the matching circuit MA2 and the antenna connector SMT2 are connected to the RF chip of the main board via the antenna connection cable CA1. The function of the matching circuit MA2 is as follows. The matching circuit MA2 performs impedance matching between the antenna ANT1 and the antenna connector SMT2, and transmits a high-frequency radio signal from the antenna connection cable CA1 to the antenna ANT1 without any loss. Simultaneously, the matching circuit MA2 transmits the high-frequency radio signal received by the antenna ANT1 to the RF chip via the antenna connection cable CA1. The matching circuit MA2 of the ordinary type can be used, and this is not specific to this invention, so that the detail thereof will not be described.

The power-on reset circuit POR1 generates a signal for resetting the microprocessor chip mounted on the main board BO1 during power-on. The power-on reset circuit can generate a reset signal by pressing the manual reset switch RSW1. This circuit is effective when the microprocessor chip runs away out of control for some reason during the operation, and the like. Regarding the power-on reset circuit POR1, a general circuit can be used, and this circuit is not specific to this invention, so the detail thereof will not be described.

The serial-parallel conversion circuit SPC1 sets the operating mode of a pulsebeat sensor via the pulsebeat sensor LED-light strength control signal line LDS, and the pulsebeat sensor power supply interrupt control signal line PSS. The serial-parallel conversion circuit SPC1 is connected to the serial-bus signal line SB, and can be controlled with the program mounted on the microprocessor chip via a serial-bus. As described above, when the serial-parallel conversion circuit SPC1 is accessed from the microprocessor chip via the serial-bus signal line SB, the serial-parallel conversion circuit SPC1 needs to be activated previously by the serial-bus control circuit BS2 (FIG. 9) mounted on the second surface SIDE2.

The display unit LMon1 can display character strings and graphics in accordance with a display request from the microprocessor chip. The display unit LMon1 is preferably a low current consumption type that can be operated by the small battery BAT1 for a long period of time. Therefore, a display unit such as a monochromatic LCD or the like capable of displaying with a low power consumption is preferable. Furthermore, very fine dots (high resolution) are not suitable in terms of visibility and other aspects. Furthermore, there is a strict constraint in a size with respect to the wristband sensor node SN1. Therefore, typically, a monochromatic LCD having a display dot of about 32×64 dots is preferable for the wristband sensor node of this invention. The current consumption varies largely depending upon the LCD display size. In the case of the dot number of about 32×64, typically, the current consumption value is about 0.1 mA. It is preferable that the LCD display unit has a standby mode capable of reducing a current consumption while the user is not using the apparatus (for example, while the user is sleeping) in terms of the life battery. According to the current technology, typically, an apparatus with a current consumption of 1 μA or less during standby is available. An LCD specific to this invention is not particularly required. A general LCD can be used. Herein, the detail thereof will not be described.

The display control with respect to the display unit LMon1 is performed with the program mounted on the microprocessor chip by the serial-bus signal line SB. As described above, prior to the access to the display unit LMon1, the serial-bus control circuit BS2 needs to set the right of use of a serial-bus at the display unit LMon1, thereby activating a chip enable terminal CE of the display unit LMon1. Data to be displayed is of the dot type, so the display of graphics can be performed. However, it is not advantageous in terms of the air efficiency to convert a character string message to graphics of 32×64 dots and download them, every time a character string message is merely desired to be displayed from the basestation BS10, because the size of radio data becomes large. On the other hand, if character fonts are previously prepared in a non-volatile memory in the microprocessor chip, only a character code of a message desired to be displayed is downloaded from the basestation BS10, so the radio data size can be reduced remarkably. However, the general size of the non-volatile memory in the microprocessor chip is at most about 128 KB in the current semiconductor technology, so all the Chinese characters cannot be contained as a character font. More specifically, it is not realistic to handle an arbitrary display message containing Chinese characters. Therefore, in the wristband sensor node of this invention, only characters (including Chinese characters) that are used often are contained as a font in the non-volatile memory in the microprocessor chip, and when it is desired to display other characters, prior to the download of a character message, a required character font is downloaded from the basestation BS10. According to this system, arbitrary characters including Chinese characters can be displayed without decreasing the air efficiency and with only the ordinary microprocessor chip. As described above, this display control system is suitable for the wristband sensor node.

The regulator REG1 (FIG. 8) is used for generating a stabilized power supply line VDD from the power supply line $V_{bb}$ supplied from the secondary battery BAT1 mounted on the second surface SIDE2. Regarding the secondary battery BAT1, a lithium-ion secondary battery that can be miniaturized and has excellent large current discharge characteristics is preferable. However, the lithium-ion secondary battery has a discharge start voltage of about 4.2 V. On the other hand, in the case of using the most popular semiconductor technology at this time, the maximum value of an operation voltage of the RF chip and the microprocessor chip is about 3.8 V. In other words, the power supply cannot be performed directly from the lithium-ion secondary battery. Furthermore, in the lithium-ion secondary battery, the battery voltage decreases relatively gradually along with the discharge, and a recommendable value of the general discharge completion voltage is about 3.2 V. In other words, the battery voltage varies over a wide range depending upon the discharge depth. Therefore, it is preferable to stabilize the power supply voltage VDD with the regulator REG1. Regarding the regulator REG1, a general low drop/low current consumption type can be used, so the detail will not be described here. According to the current semiconductor technology, a regulator with a drop voltage of 0.2 V or less and a current consumption of about 1 μA is available.

Figure 18A:
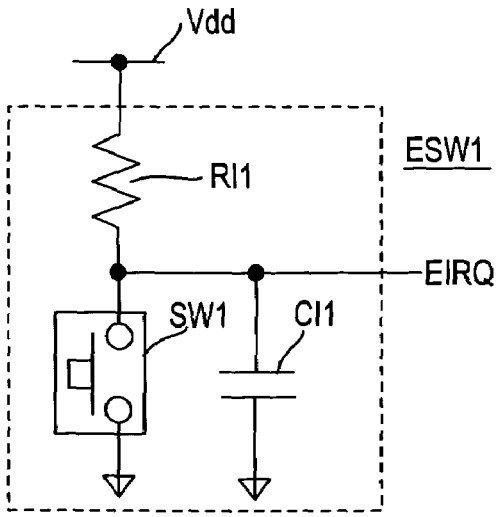
FIG. 18A is a circuit diagram of an emergency switch ESW1 used in the wristband sensor node.
Figure 18B:
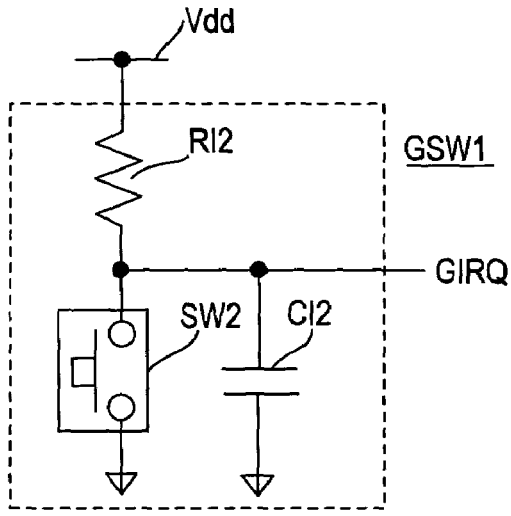
FIG. 18B is a circuit diagram of a measurement switch GSW1 used therein.

The emergency switch circuit ESW1 and the measurement switch circuit GSW1 will be described. FIGS. 18A and 18B show exemplary circuit configurations thereof. FIG. 18A shows a configuration of the emergency switch ESW1, and FIG. 18B shows the measurement switch GSW1. As shown in FIGS. 18A and 18B, the switch circuits ESW1, GSW1 are composed of button-type switches SW1, SW2 accessible from the case CASE1, pull-up resistors RI1, RI2, and noise removal capacitors CI1, CI2. Outputs EIRQ, GIRQ of the switch circuit are connected to external-interrupt inputs IRQ/I2, I3 lines of the microprocessor chip. When the wearer presses the switch SW1 or SW2, the interrupt input line pulled up by the pull-up resistors RI1, RI2 drops to a "0" level, whereby an interrupt signal can be generated with respect to the microprocessor chip. As described later, by using the above-mentioned switches in combination with the program mounted on the microprocessor chip, an emergency call and the like can be notified to the basestation. In the circuits shown in FIGS. 18A and 18B, the capacitors CI1, CI2 prevent an interrupt from being applied erroneously due to the noise, in addition to the removal of a chattering signal. As shown in FIGS. 18A and 18B, when the switch SW1 or SW2 is pressed, a current flows through the pull-up resistors RI1, RI2. Therefore, in order to suppress a current consumption, the pull-up resistors RI1, RI2 need to be set at a high resistance value. Typically, it is preferable that the pull-up resistors RI1, RI2 are set to be 100 KΩ or more. However, on the other hand, when the pull-up resistance is set to be high, the pull-up resistors RI1, RI2 generally becomes sensitive with respect to the noise, which degrades noise resistance. Therefore, as shown in FIGS. 18A and 18B, a system in which an integrating circuit is composed of a capacitor is preferable in terms of a power consumption and noise resistance.

Figure 19A:
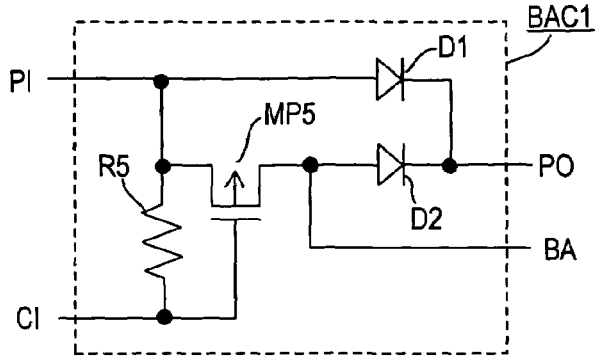
FIG. 19 A is a circuit diagram of a charge control circuit BAC1 used in the wristband sensor node.
FIG. 19B is a circuit diagram of a charge terminal PCN1 used therein.
Figure 19B:
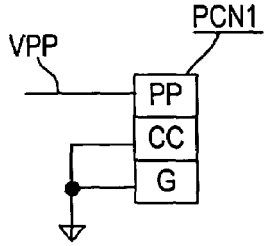

Next, FIG. 19A shows the charge control circuit BAC1, and FIG. 19B shows the charge terminal PCN1. By using an outboard charger in combination with the charge terminal PCN1, charging can be performed without removing the built-in secondary battery BAT1 and without interrupting the operation of the wristband sensor node SN1.

Hereinafter, the operation will be described with reference to FIGS. 19A and 19B. First, during an ordinary operation, nothing is connected to a terminal PI of the charge control circuit BAC1. Therefore, a power is supplied from the built-in battery BAT1 to the regulator REG1 of the motherboard in a path: a BA terminal→diode D2→PO terminal, connected to the built-in battery BAT1 in FIG. 8. Next, the operation during charging will be described. During charging, first, an external charger sets the charge control terminal CI of the charge control circuit BAC1 to a "0" level via the charge terminal PCN1. When the charge control terminal CI is set to be "0", a P-type MOS transistor MP5 of the charge control is brought into conduction, and charging becomes possible in a path: an external charger→PI terminal→MP5→BA terminal→built-in battery BAT1. After this, the voltage of the terminal PI of the charge control circuit BAC1 is monitored appropriately on the external charger side. When the voltage of the terminal PI reaches a defined voltage, the charge control terminal CI is set to be "1" to turn off the P-type MOS transistor, thereby terminating the charging. Regarding the charge control system, a general charge control system such as CCCV is applicable, so the detail thereof will not be described here.

Even during charging, a power can be supplied to the wristband sensor node SN1 in a path: PI terminal→diode D1→PO terminal. In other words, even in a charging state, the supply of a power to the wristband sensor node SN1 is not interrupted. In other words, charging can be performed without interrupting the operation of the wristband sensor node. As described above, by using the charge control circuit BAC1, the wristband sensor node can be charged while being used, so appropriate charging can be realized in the wristband sensor node SN1.

The acceleration sensor AS1 detects whether or not the user is moving. The acceleration sensor AS1 is typically of an analog type, and converts the movement of the user into a digital value with an AD conversion circuit contained in the microprocessor chip so as to detect the status of the user with an appropriate detection program. As described later, by using the user status obtained with the acceleration sensor in combination with the program mounted on the microprocessor chip, a pulsebeat can be sensed stably with low power consumption. As the acceleration sensor AS1, the one that supports a standby operating mode is used. This is because it is necessary to suppress the power consumption by setting the acceleration sensor AS1 in a standby state in the wristband sensor node SN1 while it is not being used, in order to realize a long-term operation with the small battery BAT1. In the current semiconductor technology, an acceleration sensor AS1 with a current consumption of 1 μA or less during standby is available without any problem. Furthermore, an acceleration sensor with a current consumption of about 1 mA or less, typically about 0.5 mA during operation is available. In the wristband sensor node, a standby setting terminal STB of the acceleration sensor AS1 is activated by the programmable input/output circuit PIO of the microprocessor chip to realize the shift control to a standby state.

The case attachment holes TH20, TH21, TH22 and AH20 in FIGS. 8 and 9 have been already described, so they will not be described here. The capacitors C20 and C21 are so-called bypass capacitors having a function of stabilizing a power supply.

The first surface SIDE1 of the motherboard BO2 has been described above. Next, the second surface SIDE2 will be described. First, in the same way as in the first surface SIDE1, in order to ensure the sensitivity of the antenna ANT1, the no ground/power-plane area NGA20 is set on the reverse surface of the antenna ANT1 mounted on the first surface SIDE1.

The non-volatile memory SROM1 circuit can be randomly accessed, and has a function of storing data that is not to be destroyed during power-off, e.g., information such as a MAC address used by radio. As this type of non-volatile memory, a serial EEPROM is most popular, which is most advantageous in terms of cost and a memory capacity. Typically, an EEPROM with a memory size of about 100 KB is available at low cost. Therefore, a serial EEPROM is also preferable in the wristband sensor node. The serial EEPROM needs to read or write data with a serial interface. For this purpose, in the wristband sensor node, an access system via a serial interface is used in the same way as in the access of the microprocessor chip to the display unit LMon1 and the like.

The regulator REG2 generates an analog power supply voltage $AV_{cc}$ required for operating the acceleration sensor and the pulsebeat sensor. Unlike the regulator REG1 that has been already described, the main function of the regulator REG2 is to minimize the noise entering those sensors from a power supply line, in addition to the stabilization of a voltage. As described later, the pulsebeat signal amplifier AMP1 mounted on the pulsebeat sensor board BO3 contains a high-gain amplifier in terms of its configuration, so it is sensitive to noise. Therefore, it is necessary to minimize the noise entering the sensors from the power supply. Such a regulator of a low-noise type has a disadvantage of a large current consumption. For example, typically, such a regulator always consumes a current of about 100 μA, so the wristband sensor node cannot be used in this state. In order to solve this problem, in the wristband sensor node, when the analog power supply voltage $AV_{cc}$ is not necessary, the power-off switch PS21 interrupts the supply of a current to the regulator REG2. Accordingly, the above-mentioned noise problem can be solved while the current consumption during standby is suppressed.

Figure 20A:
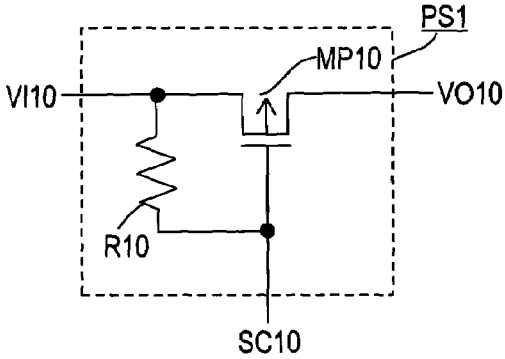
FIG. 20A is a circuit diagram showing an example of a power-off switch PS21 used in the wristband sensor node, in which a power supply is controlled by a control line SC10.
Figure 20B:
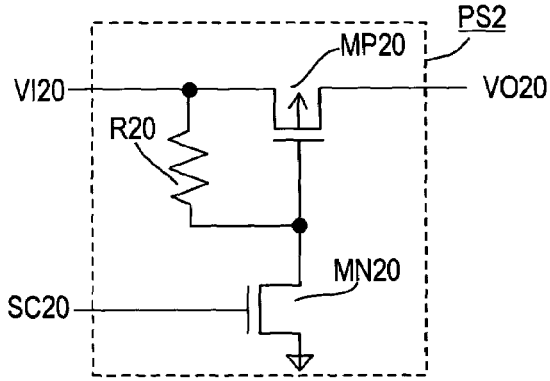
FIG. 20B is a circuit diagram showing an example of a power-off switch PS31 used in the wristband sensor node, in which a power supply is controlled by a control line SC20.

FIGS. 20A and 20B show exemplary configurations of the power-off switch PS21,(PS31). In the type shown in FIG. 20A, the supply of a power to VI10 terminal→VO10 terminal can be interrupted by setting the control line SC10 to be "1". In the type shown in FIG. 20B, the supply of a power to VI20 terminal→VO20 terminal can be interrupted by setting the control line SC20 to be "0". The power-off switch of the type shown in FIG. 20A is preferable when the power supply voltage of the control circuit for driving the control line SC10 is the same as the voltage applied to the VI10 terminal. On the other hand, the power-off switch of the type shown in FIG. 20B is preferable when the power supply voltage of the control circuit for driving the control line SC20 is different from the voltage applied to the VI20 terminal.

Figure 21:
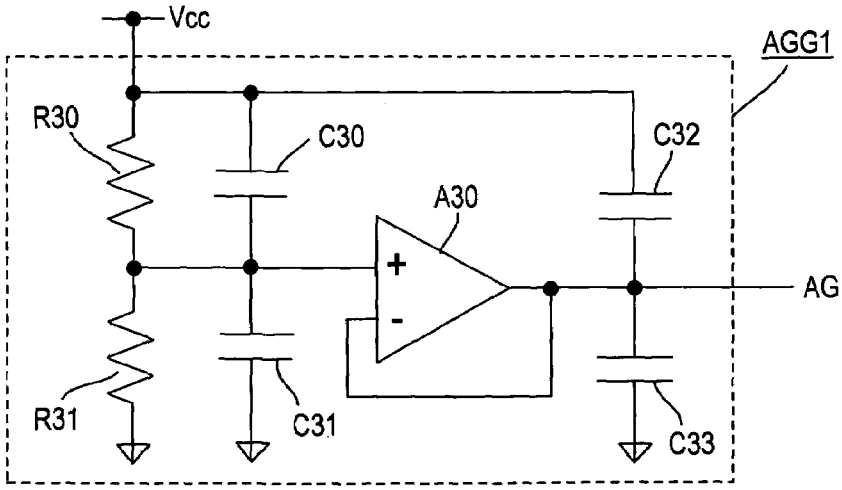
FIG. 21 is a circuit diagram showing an example of an analog reference potential generation circuit AGG1 used in the wristband sensor node.

The analog potential generation circuit AGG1 generates an analog reference potential required in the pulsebeat-signal amplifier AMP1 described later. FIG. 21 shows an exemplary configuration of the analog potential generation circuit AGG1. As shown in FIG. 21, the analog potential generation circuit AGG1 stabilizes an intermediate voltage, generated under the condition of being divided by resistors R30 and R31, with a voltage follower composed of an operational amplifier A30. In this circuit, the intermediate voltage is generated under the condition of being divided by the resistors R30 and R31, so a current flows steadily during operation. The power supply $V_{cc}$ of this circuit is $AV_{cc}$, so a current will not flow if the power-off switch PS21 turns off $AV_{cc}$. However, it is not preferable that an unnecessary current is consumed during operation. Therefore, the current consumption is suppressed by setting the resistors R30, R31 to be a high resistance. However, it is not preferable that the resistors R30, R31 are set to be a high resistance, because noise is likely to be applied to an intermediate potential point. In order to solve this problem, it is preferable to add capacitors C30, C31, C32, and C33 for removing noise.

The buzzer Buz1 is a device used for a user interface, and is of a type capable of setting on/off of a buzzer with the program mounted on the microprocessor chip. The capacitors C22, C23 are bypass capacitors for a power supply. The connectors SCN1, CN2, and the built-in battery BAT1 have been already described, so they will not be described herein.

<Detail of Pulsebeat Sensor Board BO3>

Figure 23A:
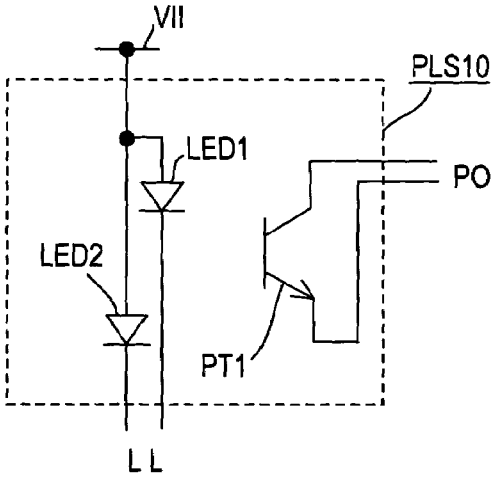
FIG. 23A is a circuit diagram showing an example of a pulsebeat sensor head circuit PLS10 used in the wristband sensor node, in which a phototransistor PT1 is used.

Hereinafter, the pulsebeat sensor board BO3 will be described. As described above, the pulsebeat sensor board BO3 irradiates the arm with infrared light by infrared LEDs (infrared light-emitting diodes LED1, LED2), and allows the phototransistor PT1 to detect the fluctuation of the stream of blood flowing under the skin of the arm as the fluctuation of scattered light, thereby extracting a pulsebeat. In order to achieve this object, the above-mentioned pulse beat sensor head circuit PLS1 (FIG. 11) is mounted on the pulsebeat sensor board BO3. The pulsebeat sensor head circuit PLS1 is composed of the infrared LEDs (LED1, LED2) and the phototransistor PT1, as shown in FIG. 23A.

Figure 23B:
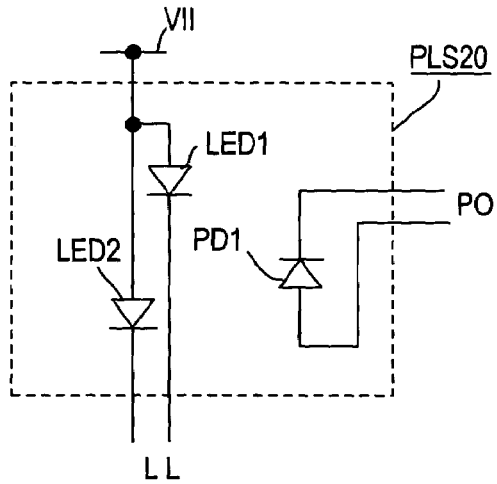
FIG. 23B is a circuit diagram showing a pulsebeat sensor head circuit PLS20 used in the wristband sensor node, in which a photo diode is used.

A method for detecting a pulsebeat using those devices has been already described, so the description thereof will be omitted here. As shown in FIG. 23B, regarding the pulsebeat sensor head circuit PLS1, a photo diode can also be used instead of a phototransistor (PLS20 in FIG. 23B).

Next, the pulsebeat-signal amplifier AMP1 will be described. As described above, in the phototransistor PT1 of the pulsebeat sensor head circuit, a change in current in accordance with the fluctuation in intensity of a bloodstream is obtained. However, in general, the change amount of a current is very small. Therefore, it is necessary to amplify the change amount to a level sufficiently detectable by the AD conversion circuit in the microprocessor chip, in the pulsebeat-signal amplifier circuit AMP1.

FIG. 24 shows an exemplary configuration of the pulsebeat-signal amplifier AMP1. A current from the phototransistor PT1 is converted to a voltage signal by an I-V conversion circuit composed of an operational amplifier A40 and a register R40. In the I-V conversion circuit, by allowing the amplifiers to have LPF characteristics formed by a register R40 and a capacitor C40, a current variation involved in the flickering of a fluorescent lamp, i.e., a signal component that is merely noise when seen from the intended bloodstream fluctuation signal is removed. The cut-off frequency formed by the register R40 and the capacitor C40 needs to be set to be sufficiently higher than a pulsebeat period.

As described above, after the current is converted to a voltage signal, the voltage signal is further amplified to a level required in the AD conversion circuit in the microprocessor chip, by a non-inverting amplifier composed of operational amplifiers A41, R43, R42, and a capacitor C42. The non-inverting amplifier is also allowed to have LPF characteristics by the capacitor C42 and a register R43. The purpose for this is also to remove a noise signal ascribed to the flickering and the like of a fluorescent lamp.

FIGS. 25A and 25B show a signal waveform example in each portion of the pulsebeat-signal amplifier AMP1. In FIGS. 25A and 25B, a TP1 section is a waveform example when the pulsebeat sensor is not worn on the arm.

In FIG. 25B, WD1 denotes a DO output terminal in FIG. 24, i.e., an output waveform example of the I-V conversion circuit in the first stage. WA1 denotes an AA output terminal in FIG. 24, i.e., an output waveform example of the non-inverting amplifier in the second stage. In this case, an excessive current is output from the phototransistor due to turbulence light. Consequently, it is understood that the operational amplifier A40 in the first stage is saturated.

Next, a TP2 section corresponds to the case where the pulsebeat sensor is worn on the arm appropriately, and the light strength of infrared LED is necessary and sufficient. WD2 denotes a D0 output terminal, and WA2 denotes a waveform example of an AA output terminal. In this case, the operational amplifier in the first stage is not saturated and operates normally. Furthermore, a noise component ascribed to the flickering of a fluorescent light is also removed completely. In this case, the amplitude of WA2 can be controlled by an irradiating infrared LED. More specifically, when the amplitude is somewhat insufficient, the pulsebeat sensor LED-light strength control circuit LDD1 is controlled to increase the light strength of the infrared LED. When the amplitude is sufficient, and the operational amplifier A40 in the first stage is relatively saturated, the light strength of infrared LED is decreased. Thus, by using the pulsebeat-signal amplifier AMP1 in combination with the pulsebeat sensor LED-light strength control circuit LDD1, pulsebeat sensing can be performed in an optimum state.

Finally, a TP3 section shows a waveform example of D0 and A0 outputs when the pulsebeat sensor is worn on the arm, and the user (wearer) is moving (for example, running). In this case, as represented by WA3 and WD3, only a disturbed waveform can be obtained, and a normal pulsebeat cannot be detected. The reason for this is as follows. The pulsebeat sensor is not worn on the arm and exposed to turbulence light at a much shorter time interval than the period of a pulsebeat. Consequently, the operational amplifier A40 in the first stage skips between the saturated state and the normal operation state. Thus, in order to detect a reliable pulsebeat, it is necessary to perform sensing while a user is in a rest state.

Figure 22:
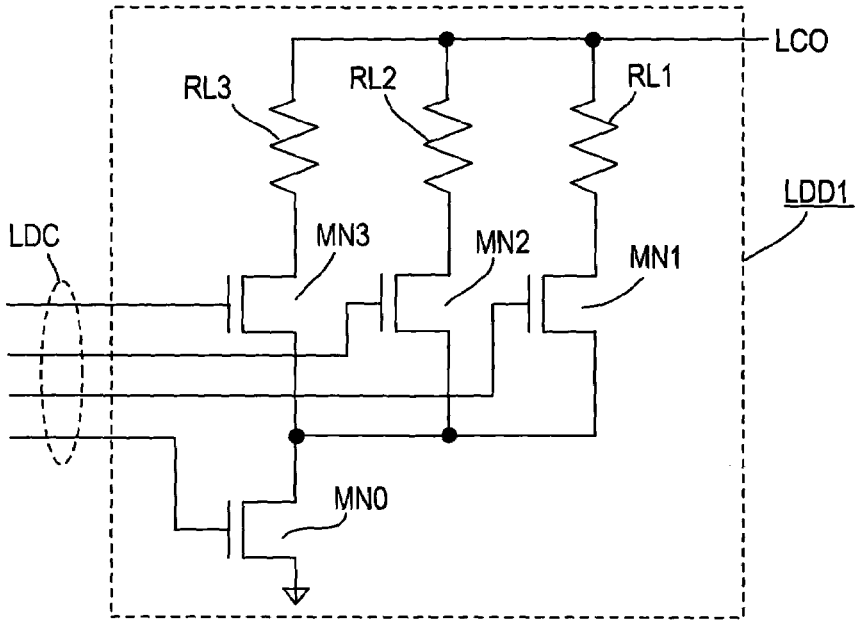
FIG. 22 is a circuit diagram showing an example of a pulsebeat sensor LED-light strength adjusting circuit LDD1 used in the wristband sensor node.

Next, the pulsebeat sensor LED-light strength control circuit LDD1 will be described. FIG. 22 shows an exemplary configuration of the pulsebeat sensor LED-light strength control circuit LDD1. This example is composed of N-type MOS transistors MN0 to MN3, and resistors RL1 to RL3. In this exemplary circuit, by controlling an LED-light strength control signal line LDC to control on/off of the MOS transistors MN1 to MN2, a current flowing through the LED can be controlled.

The regulator REG3 is used for removing noise of a power supply that supply a power to the pulsebeat sensor infrared LED. When noise is applied to a LED driving power supply, infrared light irradiated from the LED is modulated with a noise signal. Finally, a noise component is detected as a current variation by the phototransistor PT1. As a result, such a current variation is amplified by the pulsebeat-signal amplifier, which may cause a pulsebeat to be detected erroneously. Therefore, it is preferable to drive an LED with a cleanest possible power supply in which noise has been removed. Therefore, the same type of low-noise regulator mounted on the motherboard BO2 is used. As described with reference to FIGS. 5A to 5E, regarding the low-noise regulator REG3, a current consumption cannot be ignored. Therefore, while the regulator REG3 is not being used, it is preferable in terms of a power consumption to interrupt the supply of a power to the regulator REG3 in the same manner as in FIGS. 5A to 5E, i.e., with the power-off switch PS31 (FIG. 11).

<Effect of Configuration of Sensor Node>

In the sensor node SN1 of this invention, as described above, by placing the antenna ANT1 composed of a chip-type dielectric antenna in the case CASE1 in the 12 o'clock direction of the wristwatch farthest from the human body, the sensitivity can be set to be maximum. Consequently, the unnecessary power consumption can be suppressed.

As described above, in the front view of FIG. 5B, the antenna ANT1 has electromagnetic directivity in upper and lower directions (12 o'clock and 6 o'clock directions of the wristwatch) of the drawing surface. Therefore, when the antenna ANT1 is placed in a lower portion of the case CASE1, which is the other way around in the arrangement shown in FIG. 5B, the display unit LMon1 becomes an obstacle. The antenna ANT1 is also placed close to the human body, which largely degrades the sensitivity. Thus, by placing the antenna ANT1 in an upper portion (12 o'clock direction of an analog wristwatch) of the case CASE1, where the sensitivity becomes maximum, the sensitivity can be enhanced.

Furthermore, considering that the wristband sensor node SN1 is worn on the left arm, which is likely to happen for a right-handed user, by placing the antenna ANT1 on the upper left side of the case CASE1 as in the case CASE1 in FIG. 5B, the antenna ANT1 can be placed at a position away from the back of the left arm, and the sensitivity can be enhanced further.

Furthermore, the wristband sensor node SN1 of this invention is characterized in that, in order to obtain satisfactory sensitivity, the no ground/power-plane areas NGA20 and NGA30, in which neither a power supply nor a ground circuit is placed, are respectively arranged to surround the antenna ANT1 on the motherboard BO2 and the pulsebeat sensor board BO3.

In the no ground/power-plane areas NGA20 and NGA30, components cannot be placed. This is disadvantageous simply in terms of the miniaturization of mounting. However, due to the constraint of a size, an antenna that can be contained in the wristband sensor node is a chip-type dielectric antenna that can realize satisfactory sensitivity with a size shorter than the wavelength of a radio wave. In principle, in order to obtain satisfactory sensitivity, the chip-type dielectric antenna needs to be used by being mounted at some distance from the ground. For the above reason, in the wristband sensor node SN1 of this invention, by setting the no-ground/power-plane area, satisfactory radio-communication performance is ensured. More specifically, the impedance matching of the antenna ANT1 is achieved on the board unit (motherboard BO2, pulsebeat sensor board BO3, main board BO1), and under this condition, the antenna ANT1 is placed in the 12 o'clock direction of the wristwatch as described above. As a result, the antenna ANT1 is set so as not to be influenced by the human body to enhance the sensitivity.

Figure 14:
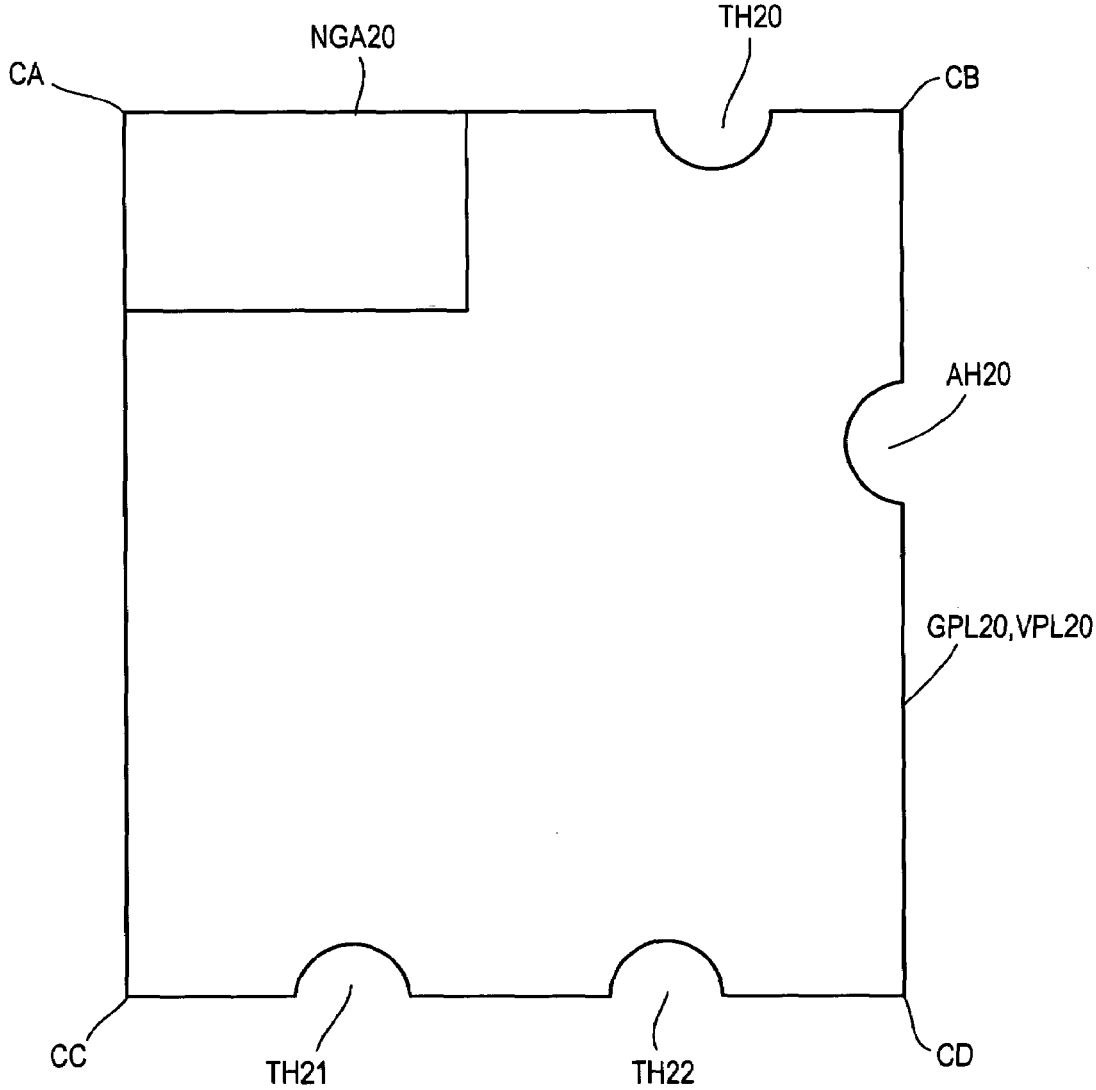
FIG. 14 is a front view showing a ground layer (GPL20), a power supply layer (VPL20), and a prohibitive area (NGA20) thereof provided in the motherboard BO2 of the wristband sensor node.
Figure 15:
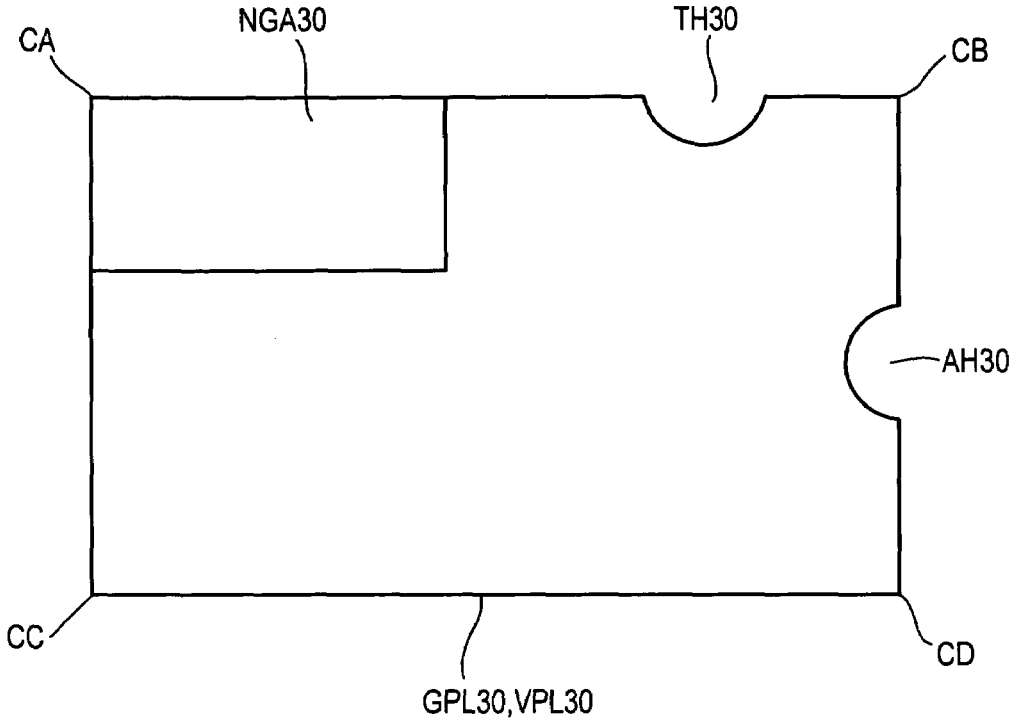
FIG. 15 is a front view showing a ground layer (GLP30), a power supply layer (VPL30), and a prohibitive area (NGA30) thereof provided in the pulsebeat sensor board BO3 of the wristband sensor node.

As shown in FIGS. 14 and 15, it is necessary that the no ground/power-plane areas NGA20, NGA30 are set not only on the board surface, but also in a ground/power supply layer for shielding mounted in the board. FIG. 14 shows configurations of a ground layer GPL20 and the power supply layer VPL20 mounted in the board of the motherboard BO2. Furthermore, FIG. 15 shows configurations of a ground layer GPL30 and the power supply layer VPL30 in the board of the pulsebeat sensor board BO3 overlapping the motherboard BO2. The wristband sensor node SN1 of this invention is characterized in that the no-ground/power-lane areas NGA20, NGA30 are arranged also in the ground/power supply layers GPL 20, 30/VPL20, 30 for the above reason. Furthermore, in the ground/power supply layers shown in FIGS. 14 and 15, by ensuring the ground for the antenna itself, stable communication can be realized.

Furthermore, the wristband sensor node SN1 of this invention is characterized in that the motherboard BO2 with the antenna ANT1 mounted thereon is worn on the arm is placed so as to be positioned on the surface opposite to the surface that comes into contact with the arm. When seen from a radio signal of 2.4 GHz or the like, the arm is considered to be equal to the ground potential. In other words, the distance from the arm to the antenna corresponds to a so-called ground clearance of the antenna. In order to realize satisfactory radio-communication performance, generally, it is desirable to set the ground clearance of the antenna. Therefore, owing to the arrangement specific to this invention in which the antenna ANT1 is mounted on the first surface of the motherboard BO2, and the main board BO1 and the pulsebeat sensor board BO3 are placed on the reverse surface of the motherboard BO2 to gain the ground clearance of the antenna ANT1, satisfactory sensitivity can be realized without degrading the radiation characteristics of the antenna ANT1.

Furthermore, as shown in FIG. 5E, as the arrangement specific to the wristband sensor node SN1 of this invention, the main board BO1 and the battery BAT1 are mounted on the opposite side of the motherboard BO2, seen from the antenna ANT1. As described above, for the purpose of suppressing noise from entering the RF chip mounted on the first surface SIDE1 from the digital circuit mounted on the main board SIDE2, two metal conductive layers connected to the power supply and the ground potential are set inside the main board BO1. Furthermore, the battery is also sealed in a metal case for the purpose of preventing the leakage of an electrolyte. The metal case of this battery is also a ground potential. On the other hand, as described above, in the case of using a small chip-type dielectric antenna, it is necessary to set a distance between the antenna and the ground potential surface. Therefore, in order to obtain satisfactory sensitivity, the arrangement of the antenna ANT1 shown in FIG. 5B is optimum. More specifically, the main board BO1 and the secondary battery BAT1 having a ground layer of one surface are placed on the reverse surface of the motherboard BO2, seen from the antenna ANT1. Furthermore, the main board BO1 and the secondary battery BAT1 are mounted closed to the CC-CD line, instead of the CA-CB line of the motherboard BO2, whereby the main board BO1 and the secondary battery BAT1 can be arranged optimally at a distance from the antenna ANT1.

Furthermore, as shown in FIG. 1, an operation switch composed of the emergency switch SW1, the measurement switch SW2, and the like operated by the user (wearer) is placed in a lower portion of the surface of the case CASE1, whereby a part of the human body such as the finger is inhibited from approaching the antenna ANT1, when the user operates the wristband sensor node SN1, and thus, the satisfactory sensitivity can be ensured at all times.

Furthermore, in the wristband sensor node SN1, as shown in FIG. 2, the infrared light-emitting diodes LED1, LED2 and the phototransistor PT1 are placed along the axis ax passing through the center in the upper and lower directions of the case CASE1, and the phototransistor PT1 is placed so as to be sandwiched between the infrared light-emitting diodes LED1 and LED2.

More specifically, by placing the light-emitting elements and the light-receiving element in a line substantially along the center of the arm, when the wristband sensor node SN1 is worn on the arm, a string of the infrared light-emitting LED1, LED2 and the phototransistor PT1 can be placed along the blood vessel flowing through the arm, i.e., along a bloodstream in the blood vessel. Even when the user (wearer) moves, the infrared light-emitting LED1, LED2 and the phototransistor PT1 can be brought into close contact with the arm, i.e., the blood vessel to be sensed. Consequently, the change in strength of infrared scattered light ascribed to the fluctuation of a bloodstream can be grasped by the phototransistor PT1 efficiently.

Furthermore, the phototransistor PT1 is placed between a pair of infrared light-emitting diodes LED1, LED2, which makes it difficult for the phototransistor PT1 that is a light-receiving element to be influenced by external light, whereby a pulsebeat can be measured stably.

<Detail of Control>

Regarding the wristband sensor node SN1 of this invention, the hardware configuration and characteristics thereof have been mainly described above. Hereinafter, regarding the configuration of a program to be mounted in the wristband sensor node SN1, the control system/routine specific to the wristband sensor node of this invention will be described. Furthermore, the microprocessor chip CHIP2 executes the program.

Hereinafter, the control system specific to this invention will be described with reference to FIG. 26.

Figure 27:
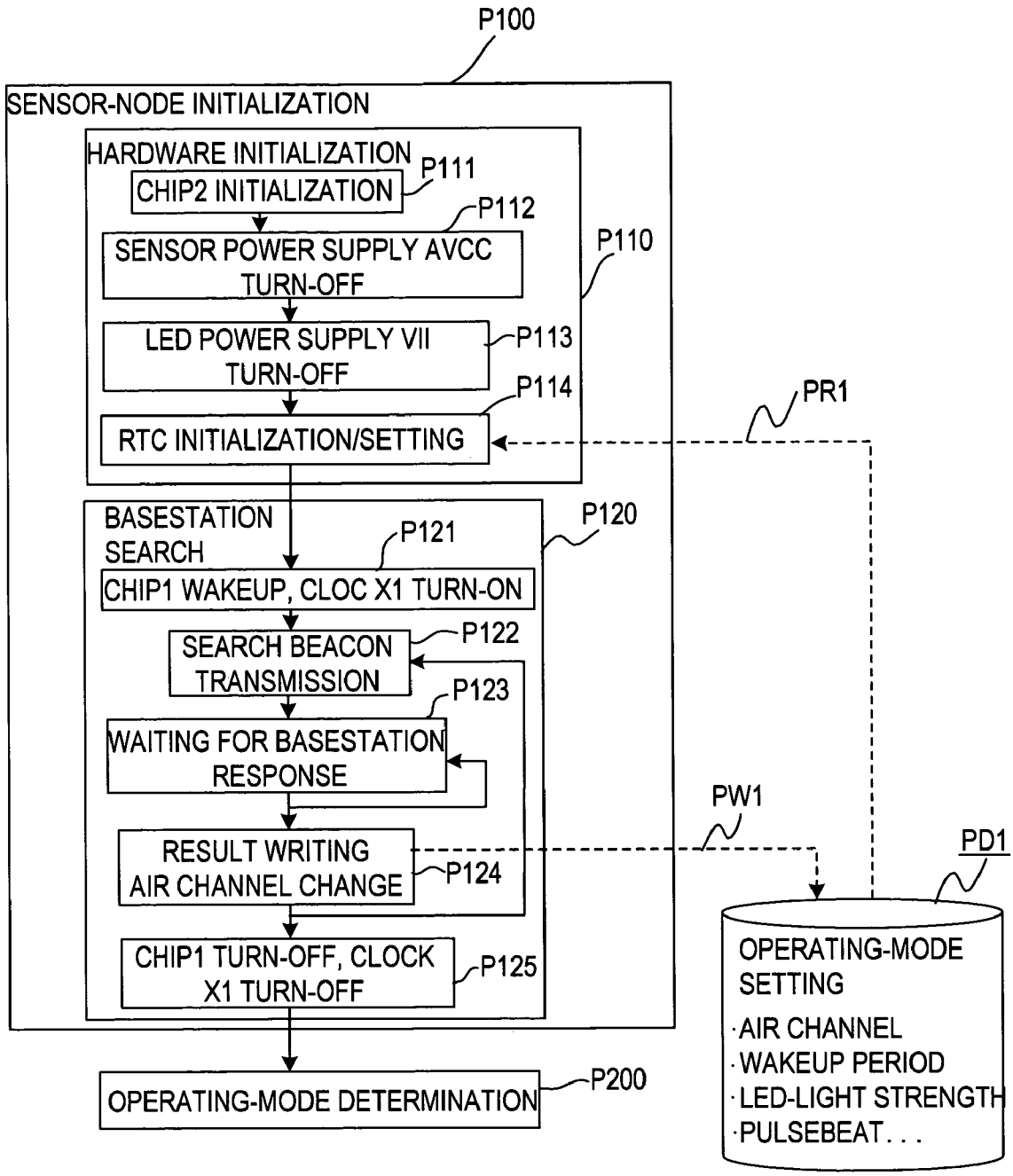
FIG. 27 is a flowchart showing a routine for initializing a sensor-node performed at P100 in FIG. 26.

In the wristband sensor node of this invention, after power-on (P1), first, a routine for initializing a sensor-node (P100) is executed. FIG. 27 shows the outline of the routine for initializing a sensor-node (P100). As shown in FIG. 27, in the routine for initializing a sensor-node (P100), first, a subroutine for initializing hardware (P110) is executed. In the subroutine for initializing hardware (P110), first, the microprocessor chip CHIP2 is initialized (P111). Next, in order to exactly turn off a sensor power supply $AV_{cc}$ and a pulse sensor LED power supply V11, control signal lines thereof are inactivated (P112, P113). Furthermore, the real-time clock circuit RTC1 is accessed via the serial-bus signal line SB, the real-time clock circuit RTC1 is initialized (P114). For initializing the real-time clock circuit RTC1, a operating-mode setting file PD1 storing operation parameters and the like, stored in a non-volatile memory portion of the memory circuit contained in the microprocessor chip CHIP2, is read (PR1), and a reference time signal for the intermittent operation for determining at which time interval a standby state is shifted to an operation state is determined based on the information. The operating-mode setting file PD1 in FIG. 27 stores, for example, a transmission rate of radio communication, a channel used in radio communication, operation parameters of a pulsebeat sensor, and the like, in addition to the reference time signal for the intermittent operation.

Next, a subroutine for searching a basestation (P120) is executed. In the subroutine for searching a basestation (P120), first, the power supply control signal line or the like of the RF chip is activated to wake up the RF chip (P121). Then, the RF chip CHIP1 is set in a transmission state, and a beacon signal for searching a basestation is transmitted to the basestation BS1, whereby the basestation BS1 is notified that the self-node is turned on to be in a communicable state (P122). Next, the RF chip is switched to a reception state, and waits for a response from the basestation BS1 with respect to the beacon signal for searching. In the case of receiving a response signal from the basestation BS1 normally, the information such as a used radio channel or the like is stored in the operating-mode setting file PD1 (PW1). In the case of not receiving a response, a radio channel to be used is changed, and the processes are executed again from P122. Finally, after the clock of the RF chip is stopped, the power supply is turned off (P125), and the process proceeds to the subsequent routine.

Figure 26:
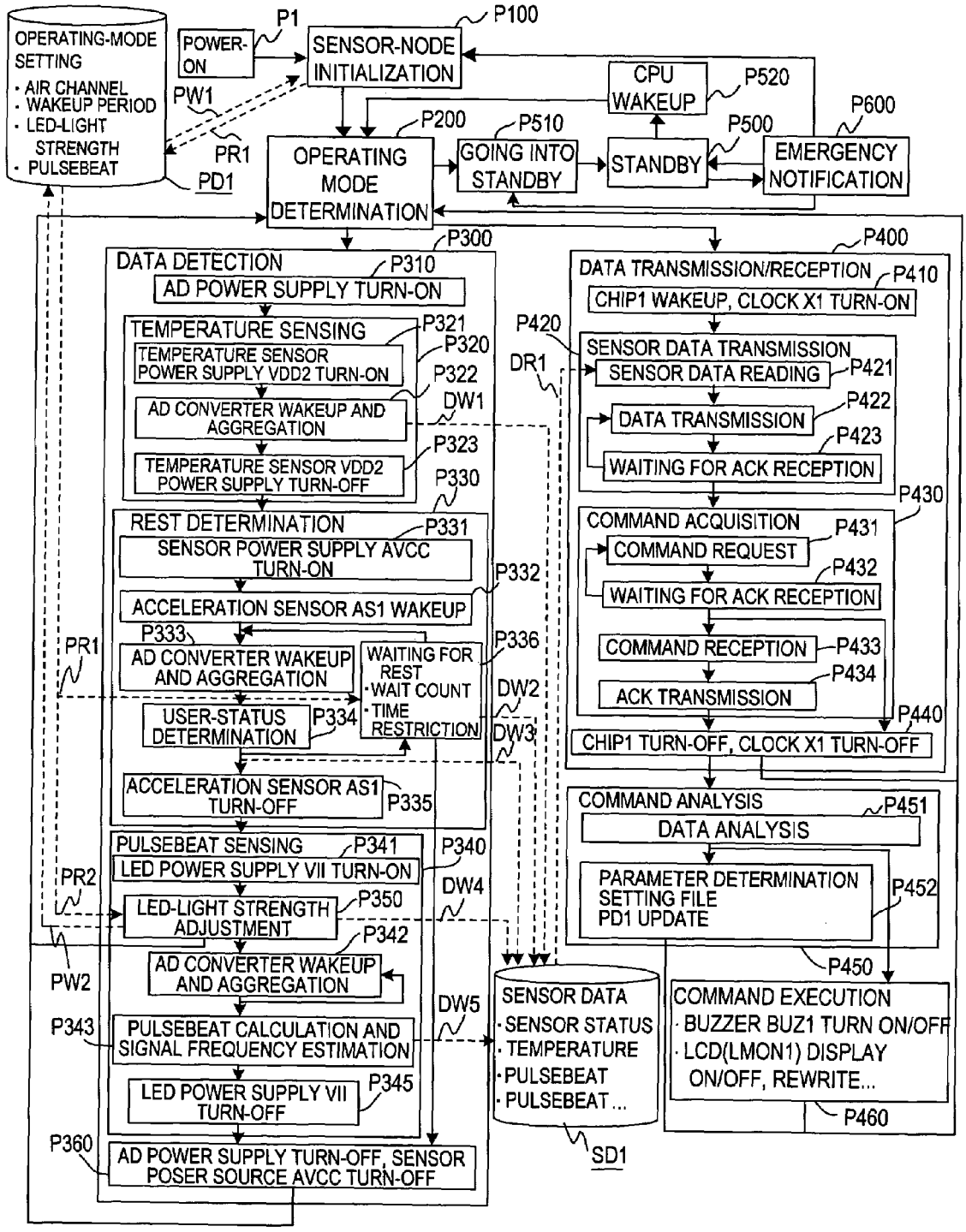
FIG. 26 is a flowchart showing an example of a control executed by the wristband sensor node.

When the routine for initializing a sensor-node (P100) is completed, the process returns to FIG. 26, and a routine for determining an operating mode (P200) is executed. From the routine for determining an operating mode (P200), a plurality of routines such as a routine for sensing (P300), a routine for transmitting/receiving data (P400), and a routine for going into standby (P510) can be executed. In the routine for determining an operating mode (P200), those three routines can be appropriately started with a scheduler. Typically, by starting those routines in the following order: routine for sensing (P300)→routine for transmitting/receiving data (P400)→routine for going into standby (P510), the intermittent operation is realized. The start-up order and the like can be changed by the operating-mode setting file PD1.

In the routine for sensing (P300), a plurality of subroutines specific to this invention are started, whereby the unnecessary power consumption is suppressed, and the stable pulsebeat sensing is realized. Those subroutines will be described successively. First, in preparation for sensing, the power supply of the AD conversion circuit in the microprocessor chip CHIP2 is turned on (P310). Then, a subroutine for sensing a temperature (P320) is executed. In the subroutine for sensing a temperature (P320), first, the programmable input/output circuit PIO of the microprocessor chip is controlled to turn on the power supply of the temperature sensor TS1 (P321). Next, an AD channel corresponding to the temperature sensor TS1 is read, and stored in a sensor data file SD1 (P322, DW1). Finally, the power supply of the temperature sensor TS1 is turned off.

As described above, the current consumption of the temperature sensor TS1 is typically about 5 μA, which is not so large current. However, in the wristband sensor node of this invention, even based on a recent technology, a battery with a capacity of about 30 mAh only can be contained due to constraint of its size. Therefore, even with a current consumption to such a degree, the temperature sensor TS1 needs to be shut off while it is not being used. For example, when a current of 5 μA is consumed at all times, 30 mAh/5 μA=6000 hours=250 days, so that the battery will be used up within one year.

After the subroutine for sensing a temperature (P320) is completed, a subroutine for determining rest (P330) specific to this invention is executed. Hereinafter, this will be described successively. In this subroutine, first, the sensor power supply $AV_{cc}$ is turned on to start supplying a power to the acceleration sensor AS1 (P331). Then, the corresponding programmable input/output circuit PIO terminal of the microprocessor chip is controlled, thereby activating a standby input terminal of the acceleration sensor AS1 to start the acceleration sensor AS1 (P332). After the acceleration sensor is started, an AD channel corresponding to the acceleration sensor AS1 is read to detect an acceleration (P333). Based on the detected acceleration, a user status is determined (P334). Specifically, the magnitude of the detected acceleration, i.e., the absolute value of the acceleration is calculated, and the absolute value is compared with a previously set threshold value. If the absolute value is less than the threshold value, it is determined that the arm of the user is in a stationary state (=rest state). When, more exactly, the arm of the user wearing the wristband sensor node SN1 of this invention is in a stationary state, it is determined that the measurement of a pulsebeat can be started, and the standby input of the acceleration sensor AS1 is inactivated (P335). Then, a subroutine for sensing a pulsebeat is started. When the arm of the user is not in a stationary state, the microprocessor chip CHIP2 waits for the arm of the user to be in a rest state for a predetermined period of time specified by the operating-mode setting file PD1 (P336), and thereafter, the processes are executed again from P333. By repeating those processes, the microprocessor chip CHIP2 waits for the arm wearing the wristband sensor node SN1 of this invention to be in a rest state.

When the wait count reaches its upper limit specified by the operating-mode setting file PD1, the sensor data SD1 is notified of the "impossibility of measurement since the arm is not in a rest state", whereby the AD power supply and the sensor power supply $AV_{cc}$ are turned off (P360), and the process proceeds to the subroutine for determining an operation (P200).

The purpose of the subroutine for determining rest (P330) is as follows. As described in FIG. 25, the pulsebeat sensor is not expected to perform stable sensing unless the arm of the user is in a rest state (WD3 and WA3 in FIG. 25). Furthermore, the pulsebeat number detected in such a state has low reliability. In other words, in order to exactly take a pulsebeat, it is a precondition that the user, more exactly, the arm wearing the wristband sensor node SN1 of this invention is in a rest state. Therefore, in the wristband sensor node SN1 of this invention, prior to the pulsebeat sensing, it is determined if the arm is in a rest state, using the contained acceleration sensor. Then, only when the arm is in a rest state, the pulsebeat sensing is performed.

Figures 29, 30:
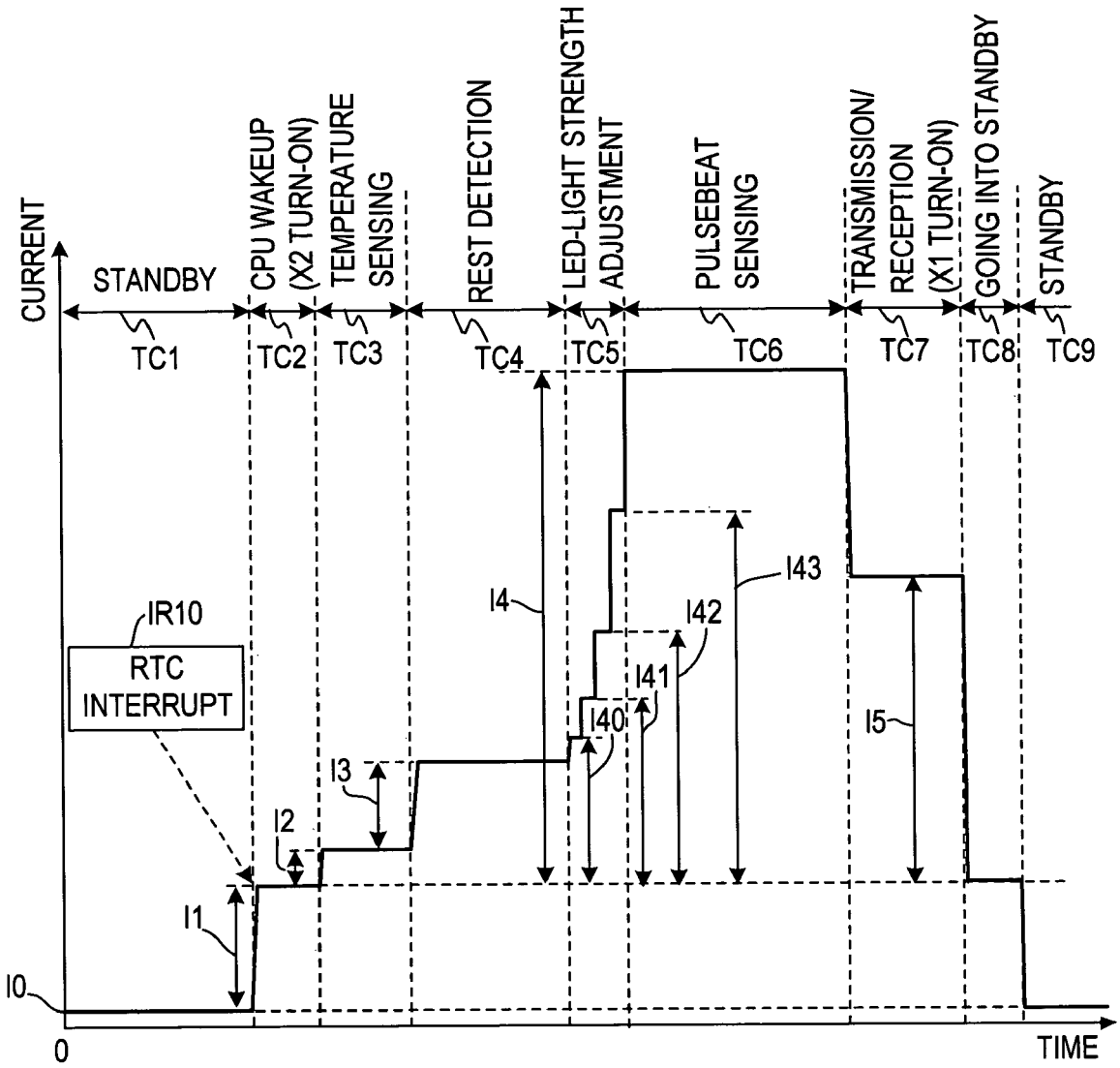
FIG. 29 is a graph showing a relationship between a current consumption and a time of the wristband sensor node.
FIG. 30 illustrates a current consumption of each element of the wristband sensor node.

It is also conceivable that the pulse sensor is started to obtain a waveform briefly, and the waveform is examined, whereby it is determined if the waveform is stable. For example, it is determined if the obtained waveform is the waveform of WA1/WD1, the waveform WA3/WD3, or the waveform of WA2/WD2 in FIG. 25, and only when the obtained waveform is the waveform of WA2/WD2, the obtained waveform is adopted. Such a system is most simple and general. However, as described above, in the wristband sensor node SN1 of this invention, only a battery having a capacity of about 30 mAh can be contained due to the constraint of its size. On the other hand, as shown in FIG. 30, it is necessary to allow the pulsebeat sensor to emit infrared light in its principle, so a current of about 10 to 50 mA is typically required for the operation of the pulsebeat sensor. Therefore, if a method of driving the pulsebeat sensor to obtain a waveform, examining the waveform data, and selecting the data, the battery is consumed significantly, and the battery life becomes very short. In contrast, according to the control system of this invention, it is possible to minimize the unnecessary pulsebeat sensing, which suppresses the consumption of the battery to prolong the life of the battery.

After the subroutine for determining rest (P330), a subroutine for sensing a pulsebeat (P340) is executed. In the subroutine for sensing a pulsebeat (P340), first, the corresponding programmable input/output circuit PIO of the microprocessor chip is controlled to turn on the LED power supply V11 (P341). Then, a subroutine for adjusting an LED-light strength (P350) specific to this invention is started to optimize the light strength of the pulsebeat sensor LED. The detail of this subroutine will be described later. Next, an AD channel corresponding to the pulsebeat sensor is read (P342). The AD channel corresponding to the sample number required for determining a pulsebeat number is repeatedly read. Typically, the AD channel corresponding to several waveforms in terms of a pulsebeat waveform is read. After reading, a pulsebeat number is calculated from the obtained pulsebeat waveform, and the results are written in the sensor data file SD1 (P343, DW5). Finally, the LED power supply is turned off to complete the subroutine for sensing a pulsebeat (P345). Furthermore, the AD power supply and the sensor power supply $AV_{cc}$ are turned off (P360), whereby the routine for sensing is completed.

Figure 28:
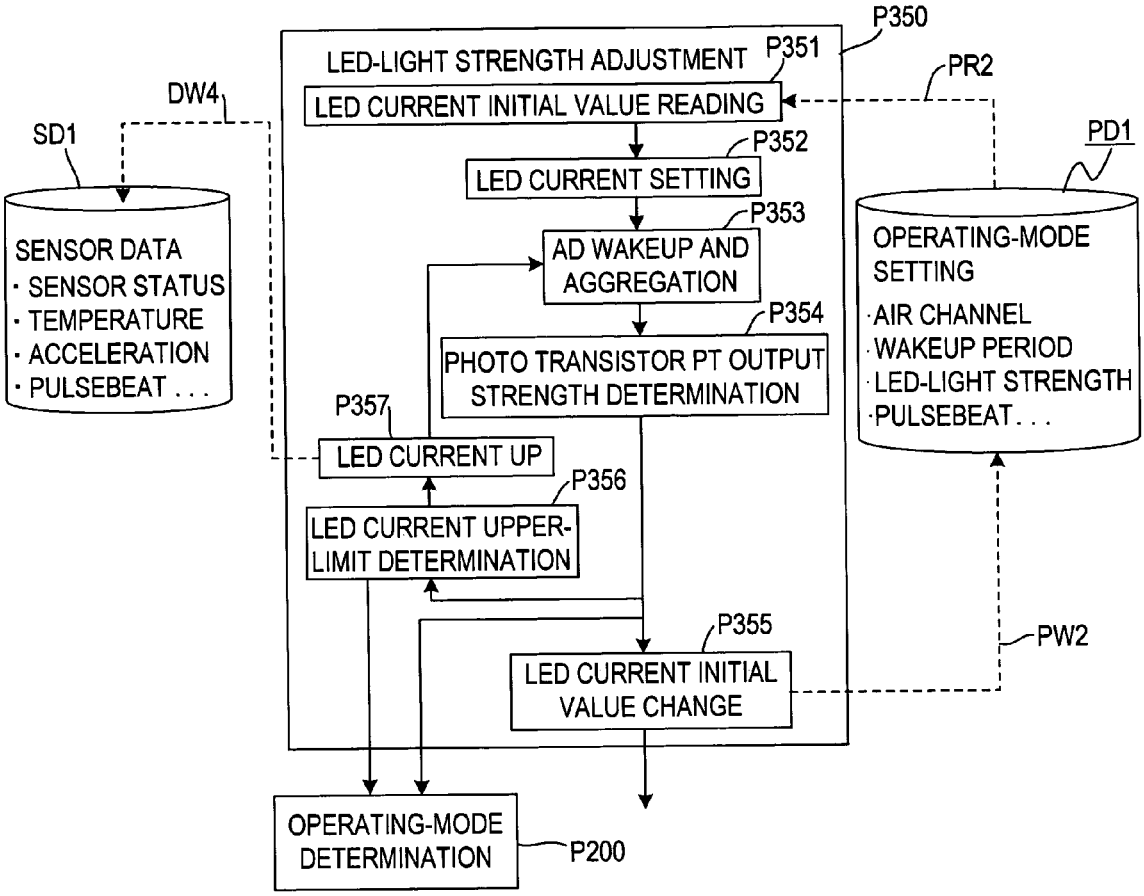
FIG. 28 is a flowchart showing a subroutine for adjusting LED light strength performed at P350 in FIG. 26.

Hereinafter, referring to FIG. 28, the subroutine for adjusting an LED-light strength (P350) specific to this invention will be described. In this subroutine, first, a default value for setting an LED-light strength is read from the operating-mode setting file PD1 (P351, PR2). Then, the pulsebeat sensor LED-light strength adjusting circuit LDD1 is controlled from the microprocessor chip via the serial-parallel conversion circuit SPC1 in accordance with the read value, whereby the current strength of the infrared LED is set (P352). Next, a voltage value of a DO output of the pulsebeat-signal amplifier is obtained in the AD conversion circuit contained in the microprocessor chip (P353). The output current strength of the phototransistor PT1 is determined from the obtained strength (P354). When the light strength of the infrared LED is insufficient, the LED current strength is increased (P357). When the output current of the phototransistor PT1 is insufficient even after the LED current is set to be a maximum strength (P356), the "impossibility of measurement due to the insufficient LED-light strength" is written in the operating-mode setting file SD1, and the process proceeds to the routine for determining an operating mode (P200). When the LED-light strength is updated when the output current strength of the phototransistor PT1 is sufficient, the strength setting value is written in the operating-mode setting file PD1, and is used as a subsequent default value.

The purpose of the subroutine for adjusting an LED-light strength (P350) is as follows. First, it is detected if the wristband sensor node SN1 of this invention is worn on the arm, and when it is not worn on the arm, the unnecessary pulsebeat sensing is prevented from being performed. It is impossible to determine whether or not the wristband sensor node SN1 of this invention is worn on the arm, only with the routine for determining rest using the acceleration sensor AS1. However, the use of the subroutine for adjusting an LED-light strength makes it possible to detect whether or not the wristband sensor node of this invention is worn on the arm, and to minimize the consumption of the battery BAT1 involved in the unnecessary pulsebeat sensing. In other words, when the voltage based on the output of the phototransistor PT1 becomes WA1 or WD1 in FIG. 25, it is determined that the wristband sensor node SN1 of this invention is not worn on the arm.

Another purpose of the subroutine for adjusting an LED-light strength is to realize stable pulsebeat sensing by correcting an individual difference of users (wearers). The change in light strength ascribed to the fluctuation of a bloodstream detected by the phototransistor PT1 generally varies greatly depending upon how much fat is present under the skin of the user, etc. In other words, in the case of a fatty user, the light strength of the infrared LED needs to be set to be large. Conversely, in the case of a user having a small amount of fat, unless the light strength of the infrared LED is set to be small, the operational amplifier in the pulsebeat-signal amplifier is saturated, so that a normal operation cannot be expected. Therefore, in order to perform stable pulsebeat sensing, it is necessary to use the subroutine for adjusting an LED-light strength to adjust the light strength of the infrared LED.

As described above, in the wristband sensor node SN1 of this invention, a stable sensing operation is realized with the subroutine specific to this invention, while the unnecessary power consumption is being suppressed.

Next, the routine for transmitting/receiving data (P400) in FIG. 26 will be described.

In the routine for transmitting/receiving data (P400), first, the corresponding programmable input/output circuit PIO of the microprocessor chip is controlled to turn on the power supply of the RF chip, thereby issuing a reset. Furthermore, the clock X1 of the RF chip is started to set the RF chip in a usable state (P410). After the RF chip is started, a radio channel to be used and other parameters are obtained referring to the operating-mode setting file PD1, whereby the setting of the RF chip is updated.

Next, in a subroutine for transmitting/receiving sensor data (P420), the sensor data SD1 is transmitted to the basestation BS10. In the subroutine for transmitting/receiving sensor data (P420), first, the sensor data SD1 is read, and processed to a data format for radio communication (P421). Typically, an error correction code, an identifier (=sensor node ID) of a self-sensor node, and the like are added to the sensor data. After the sensor data SD1 is processed to the data format for radio communication, the RF chip is set in a transmission state, and the above-mentioned data is transmitted by radio (P422). After the completion of transmission by radio, the RF chip is set in a reception state, and waits the basestation BS10 to transmit an ACK signal (P423). The ACK signal is usually a popular signal in radio communication, and is used for the purpose of confirming whether or not the transmitted data has reached the destination exactly. In the subroutine for transmitting/receiving sensor data (P420), although omitted, when the ACK signal is not transmitted from the basestation BS10 even when the RF chip waits for the ACK signal, the data is transmitted to the basestation BS10 again so that it can reach the basestation BS10 with reliability.

As the processing specific to the wristband sensor node SN1 of this invention, after the completion of the routine for transmitting sensor data, a routine for obtaining a command (P430) is executed. In the routine for obtaining a command (P430), first, the RF chip is switched to a transmission state, and a signal for inquiring whether or not there is a command desired to be transmitted to the RF chip is transmitted to the basestation BS10 (P431). In the same way as in the subroutine for transmitting sensor data, after the transmission of the inquiry signal, the RF chip is switched to a reception state, and waits for the ACK signal (P432). The basestation BS10 determines whether or not there is a command desired to be transmitted, with respect to the inquiry, and transmits the ACK signal containing information regarding whether or not there is a command desired to be transmitted to the sensor node SN1. When the sensor node SN1 determines the contents of the ACK signal and finds that there is no command from the basestation BS10, the process proceeds to P440, the clock of the RF chip is stopped to turn off the power supply, and the process proceeds to the routine for determining an operating mode (P200). On the other hand, when it is determined that there is a command, the RF chip is continued to be placed in a reception state, and waits for the basestation BS10 to transmit the command (P433). When the RF chip receives the command, the RF chip is immediately changed to a transmission state. The ACK signal showing that the command has been normally received is transmitted to the basestation BS10 (P434), and the process proceeds to P440, whereby the processing is completed. The command used in the routine for obtaining a command includes operation parameters, a display message to the display unit LMon1 mounted on the wristband sensor node of this invention, and the like.

The purpose of the routine for obtaining a command (P430) is as follows. More specifically, in the wristband sensor node SN1, due to the intermittent operation for the purpose of reducing the power consumption, the RF chip activated only when necessary, i.e., only when the sensed sensor data is transmitted to the basestation BS10. On the other hand, in the basestation BS10, for example, there may be the case where operation parameters of the sensor are desired to be changed, the display message of the display unit LMon1 is desired to be changed, or data is desired to be downloaded to the wristband sensor node SN1. When it is desired to simply download data from the basestation BS10, the power supply of the RF chip of the sensor node SN1 only needs to be put in a reception standby state. However, as described above, according to such a system, the battery is consumed immediately, and cannot be used for a long period of time. In order to solve this problem, according to this system, when the sensor node SN1 transmits data, the sensor node SN1 always inquires whether or not there is data to be downloaded to the sensor node SN1. This system enables both the reduction in power consumption and the download from the basestation BS10.

When there is a command from the basestation BS10 after the completion of the routine for transmitting/receiving data, a routine for analyzing a command (P450) is executed. In this routine, a signal transmitted from the basestation BS10 is analyzed (P451), and first, it is determined whether or not the signal is an operation parameter or a command such as a display message on the display unit LMon1. Next, when the signal is an operation parameter, the operating-mode setting file PD1 is updated by a subroutine for setting a parameter (P452). When the signal is a command, required processing is executed by a subroutine for executing a command (P460). Typically, the required processing is rewriting of a message on the display unit LMon1, or the like. As described above, after the completion of the required processing, the process proceeds to the routine for determining an operating mode (P200).

In the routine for determining an operating mode (P200), after the completion of the routine for transmitting data, the routine for going into standby (P510) is started, and the process proceeds to a standby state (P500). In the routine for going into standby (P510), the clock X2 of the microprocessor chip is stopped, the processing required for proceeding to a standby state, such as the processing for proceeding to a software-standby mode, is executed. Furthermore, the real-time clock circuit RTC1 is accessed, and a time interval until the subsequent activating is set, and an external interrupt such as an interrupt from the real-time clock RTC and an interrupt from the emergency switch (ESW1) is permitted. The activating from the standby state (P500) after the completion of the standby time is realized by the interrupt from the real-time clock RTC, as described above.

FIG. 29 shows a series of processing flow controlled by the program, and a typical current waveform example. FIG. 30 shows a typical value of a current consumption in each processing state.

During a time TC1, the microprocessor chip is in a software-standby mode, and the current consumption is suppressed to 1 μA or less. When the real-time clock circuit RTC1 enters a time TC2 after an elapse of a predetermined time, and generates an interrupt of the real-time clock RTC to activate the quartz oscillator X2, which activates the microprocessor chip. Thus, the real-time clock circuit RTC1 enters the routine for detecting data (P300) through the standby state and the routine for determining an operating mode (P200). Owing to the activation of the microprocessor chip, during the time TC2, the current is amplified to I1 (=5 mA).

The routine for detecting data (P300) is executed during the times TC3 to TC5. First, the AD conversion circuit of the microprocessor chip is turned on, and the power supply of the temperature sensor TS1 is turned on, whereby the measured value of the temperature sensor TS1 is obtained. During a time TC3, the current value becomes I1+I2 owing to the activation of the temperature sensor TS1.

After the temperature is obtained, the temperature sensor TS1 is stopped, and the acceleration sensor AS1 is activated during a time TC4, whereby a rest state is detected (P330). Owing to the starting of the acceleration sensor AS1, during the time TC4, the power consumption of the sensor node SN1 becomes I1+I3 (=0.5 mA).

As a result of the detection of a rest state, if a rest state is detected, the acceleration sensor AS1 is turned off, and then, the output of the infrared LED is increased gradually from the default value during a time TC5 to be optimized. Then, a pulsebeat is sensed with the infrared LED and the phototransistor PT1 during a predetermined time TC6. During the time TC6, the consumption of a current becomes maximum, whereby a power of I1+I4 (=10 to 50 mA) is consumed.

When the sensing of a pulsebeat is completed, the infrared LED and the phototransistor PT1 are turned off, and then, the RF chip is driven during a time TC7. Then, during the TC7, the communication with the basestation BS10 is performed, and the transmission of data and the reception of a command are performed as described above. The current consumption during the time TC7 is I1+I5 (=20 mA), which is a second largest current consumption.

When the transmission and reception during the time TC7 are completed, the RF chip and the clock X1 are turned off, and the microprocessor chip is shifted to a standby state during a time TC8. After the real-time clock RTC and the like are set, the microprocessor chip is shifted to a standby state during a time TC9, and a cycle of the above-mentioned TC1 to TC8 is repeated.

As described above, in the sensor node SN1 of this invention, after the microprocessor chip in a software-standby mode is activated with an interrupt of the real-time clock RTC, measurement is performed successively, and every time each measurement (communication) is completed, the activated sensor and chip are stopped, whereby a current consumption (power consumption) is suppressed. In other words, in measurement and communication, only the sensor and chip related to each processing are driven in addition to the microprocessor chip, and the other sensors and chips are stopped, whereby the power consumption can be minimized.

Then, it is determined, from the measurement results of the acceleration sensor AS1 whose power consumption is much smaller, whether or not the pulsebeat sensor with a largest power consumption should be driven, whereby the drive of the pulsebeat sensor and RF chip during the times TC 6 to TC 7 can be cancelled except for the rest state where the exact measurement of a pulsebeat can be performed. The drive of the infrared LED and the like is prohibited except for a rest state, whereby unnecessary power consumption can be avoided and the consumption of the battery BAT1 can be avoided, whereby a long-term operation of the sensor node SN1 can be ensured.

The acceleration sensor AS1 constitutes a first sensor for detecting the movement of a living body (human body), and the pulse sensor (infrared LED1, LED2, phototransistor PT1) constitutes a second sensor for measuring the information of the living body.

Figure 31:
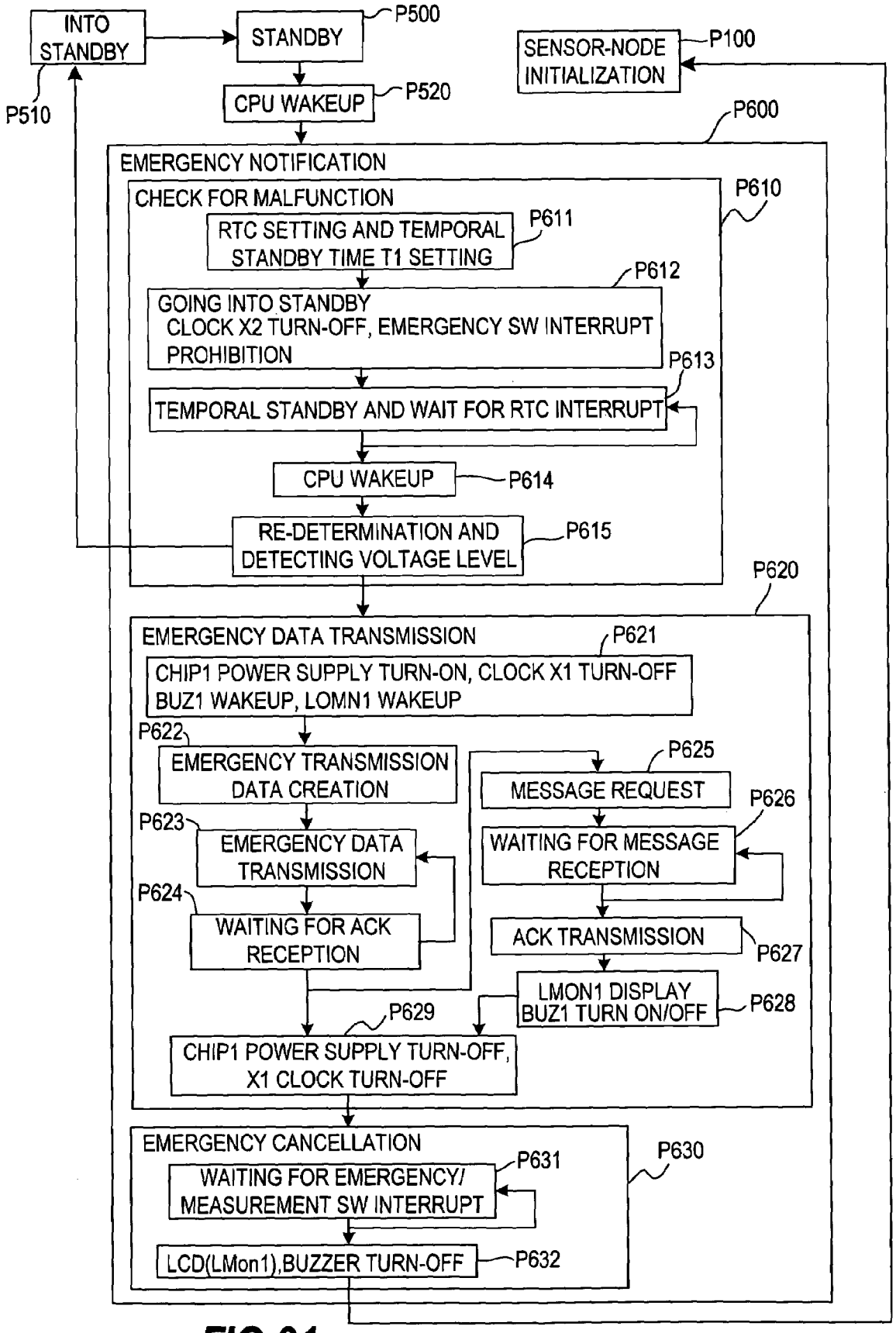
FIG. 31 is a flowchart showing an example of a routine for an emergency call.

Next, as shown in FIG. 31, as the function specific to the wristband sensor node of this invention, the standby state (P500) can be shifted to a routine for notifying an emergency (P600) that is specific to this invention by an interrupt of the emergency switch ESW1. Hereinafter, the routine for notifying an emergency (P600) will be described.

In the routine for notifying an emergency (P600), first, a subroutine for preventing a malfunction (P610) is executed. In the subroutine for preventing a malfunction (P610), first, the real-time clock circuit RTC1 is accessed and is set such that the real-time clock RTC1 is interrupted after the elapse of a temporal standby time T1 (P612). As the temporal standby time T1, typically about 3 seconds is set. Next, the emergency switch interrupt is set in a prohibited state, and the clock X2 of the microprocessor chip is stopped, whereby the microprocessor chip is shifted to a software-standby mode. When the set temporal standby time T1 elapses, and an interrupt of the real-time clock RTC occurs, the microprocessor chip is activated (P614), and the level of an emergency switch input is detected again (P615). If the emergency switch is continued to be pressed, a subsequent subroutine for transmitting emergency data (P620) is activated. If the emergency switch is not pressed when the level of the emergency switch is detected again, the subroutine for going into standby (P510) is executed to go into the standby state (P500) again.

The purpose of the subroutine for preventing a malfunction is as follows. The subroutine for preventing a malfunction minimizes the unnecessary power consumption ascribed to the erroneous operation of the emergency switch. In the wristband sensor node SN1 of this invention, in order to reduce the power consumption, when sensing is not executed, the microprocessor chip and the like are shifted to a standby state to suppress the power consumption completely. On the other hand, when an emergency call is made for the reason such as the bad shape of a user, the user's request cannot be responded in a standby state. In order to address this problem, as described above, in the wristband sensor node of this invention, the emergency switch ESW1 (SW1) is assigned to an external interrupt of the microprocessor chip, and when the emergency switch (ESW1) is pressed, the microprocessor chip is recovered from the standby state immediately so as to respond to the user's request. However, a switch is likely to involve an erroneous operation. Chattering is also present. Therefore, in general, in the case of a switch with a high emergency degree, the microprocessor is configured so as not to react unless the emergency switch ESW1 is continued to be pressed for a predetermined period of time or more. In order to realize this operation, simply, a timer may be composed of the microprocessor chip, and after the elapse of a specified time, it may be detected whether or not the emergency switch is still pressed as in this system. However, according to such a simple system, it is necessary to continue to activate the microprocessor chip for a predetermined period of time or longer, and a current of about 5 mA is typically consumed (FIG. 30). More specifically, such a simple system cannot be applied to the wristband sensor node of this invention whose most important item is to reduce the power consumption. Furthermore, when an emergency switch interrupt mistakenly occurs frequently due to the erroneous operation of the switch or the like, the microprocessor chip is continued to be activated, which increases the power consumption.

This system is achieved in order to solve the above-mentioned problem. According to this system, the microprocessor chip is activated after the occurrence of an emergency switch interrupt. After this, the microprocessor chip sets the real-time clock RTC, and is immediately shifted to a software-standby mode. While it is determined whether or not the emergency switch SW1 is continued to be pressed, the microprocessor chip can be on standby in a software-standby mode. In other words, even when an emergency switch interrupt mistakenly occurs frequently, the current consumption can be suppressed to a standby state with reliability.

Figure 32A:
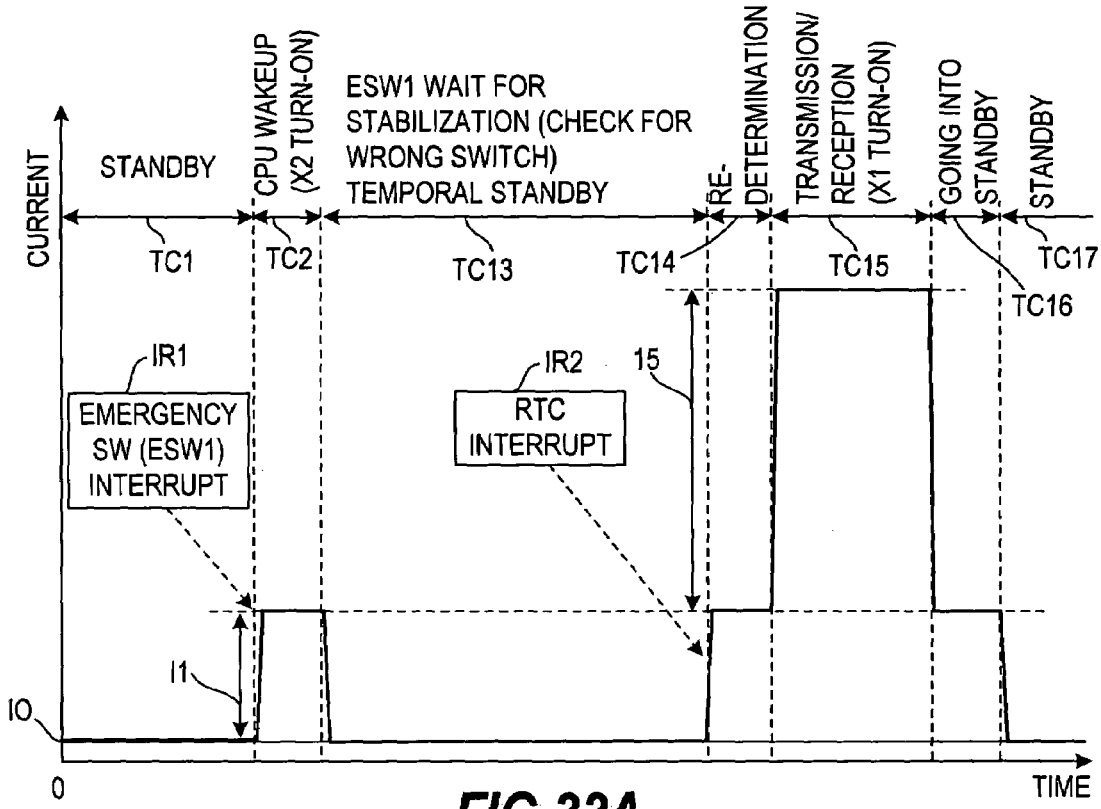
FIG. 32A is a graph showing a relationship between a current consumption and a time at an emergency call of the wristband sensor node, in the case of using a routine for an emergency call of this invention.
Figure 32B:
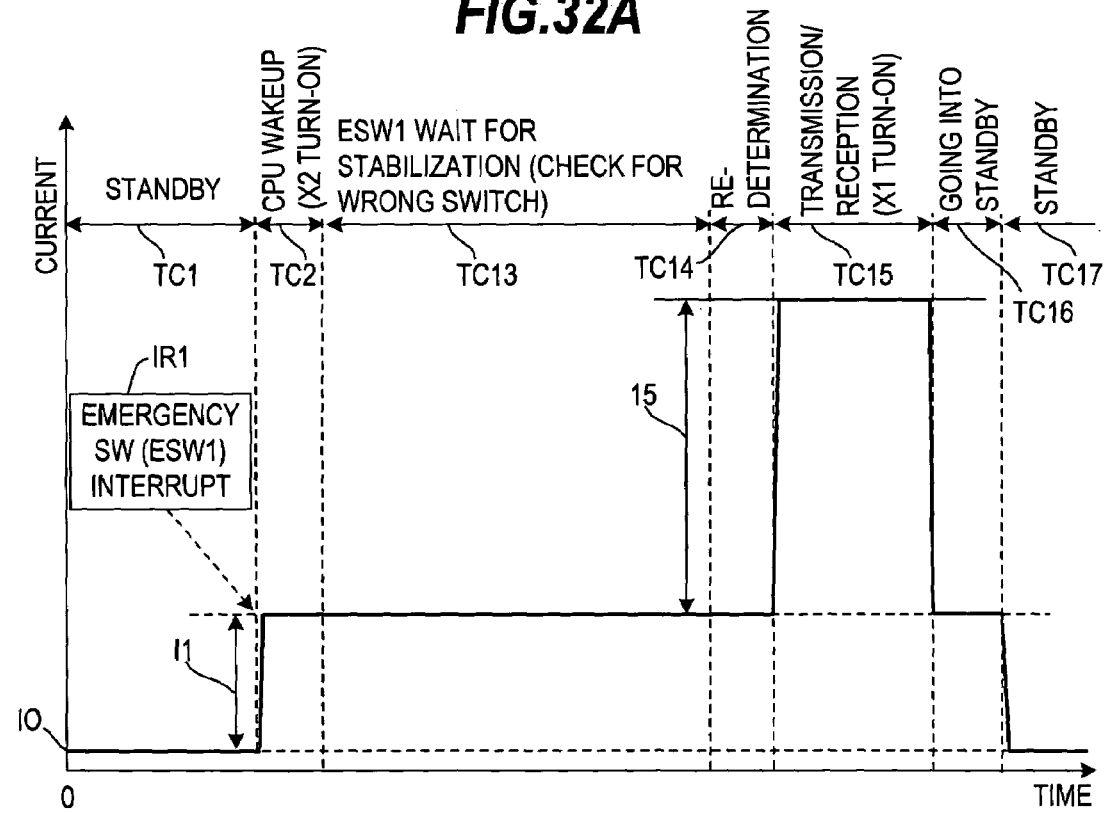
FIG. 32B is a graph showing a relationship between a current consumption and a time at an emergency call of the wristband sensor node, in the case of not using a routine for an emergency call of this invention.

The graph shown in FIG. 32A shows the effect of the above-mentioned routine for notifying an emergency. FIG. 32B shows the case where this system (routine for notifying an emergency) is not adopted.

TC13 in FIGS. 32A and 32B denotes a wait time for detecting an emergency switch again. Furthermore, a time TC15 corresponds to a time taken for data communication of an emergency call. In those figures, the time TC13 and the time TC15 are drawn almost equally. However, actually, TC 13: ~3 seconds, and TC 15: 0.1 seconds or less.

Thus, the reduction in the current consumption by this system is very effective.

As described above, when it is determined that the emergency switch ESW1 is pressed actually, a subroutine for transmitting emergency data (P620) is executed. In this subroutine, first, the RF chip is activated (P621). Next, emergency data to be transmitted to the basestation BS10 is created (P622). Then, the RF chip is set in a transmission state, and the emergency data is transmitted (P623). Furthermore, the RF chip is set in a reception state, and is allowed to wait for an ACK signal from the basestation BS10 to check whether or not the emergency call has reached the basestation BS10 exactly (P624). When required, routines (P626 to P628) are executed, whereby a message from the basestation BS10 can be downloaded to be displayed on the display unit LMon1.

Second Embodiment

Figure 33:
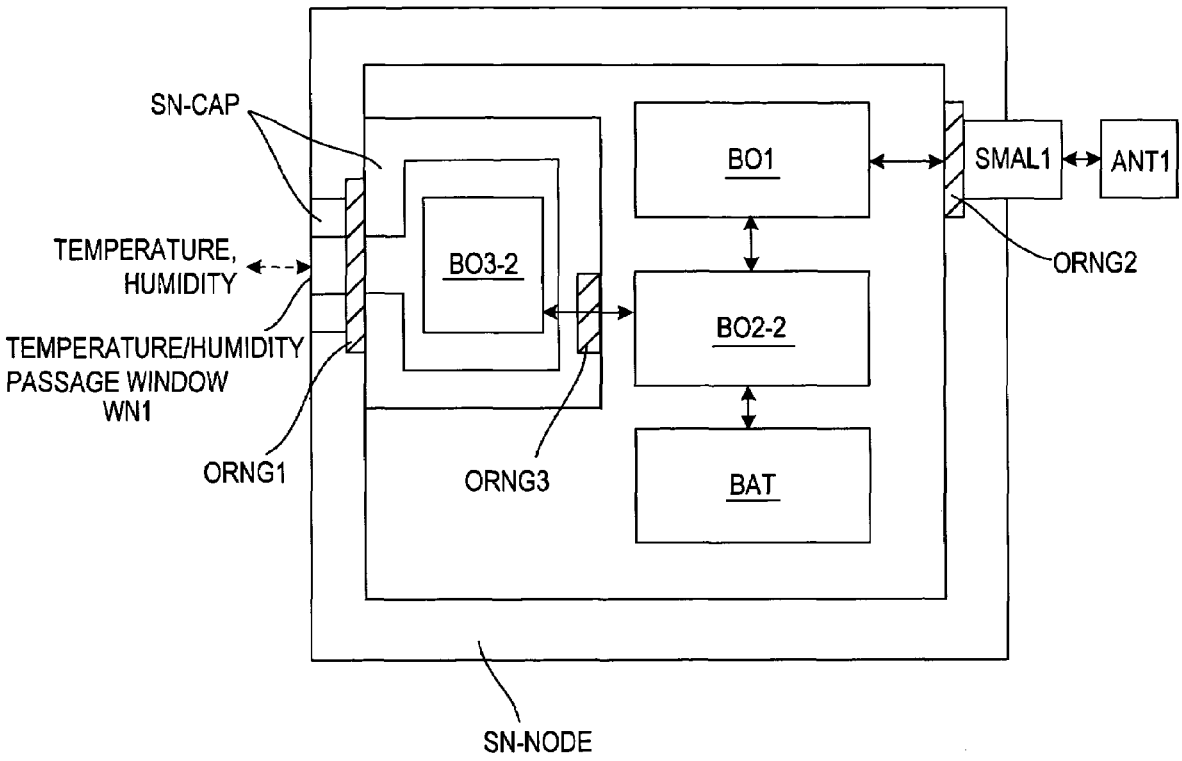
FIG. 33 is a schematic view of a sensor node in a second embodiment.

FIG. 33 shows a second embodiment, and the temperature sensor TS1 in the first embodiment measures humidity in addition to temperature.

In the case of the sensor node SN1 with the temperature/humidity sensor TS1 for sensing temperature and humidity mounted thereon, it is necessary that the indoor and outdoor air is sensed directly with the temperature/humidity sensor TS1. Therefore, the temperature/humidity sensor TS1 and the control circuit for the sensor node SN1 are mounted in the same environment as that of the indoor and outdoor. Condensation occurs on the surface of the control circuit due to the change in temperature and humidity in the vicinity of the control circuit, which causes the malfunction and failure.

Thus, ordinarily, the temperature/humidity sensor TS1 is mounted separately from the control circuit of the sensor node SN1. For example, the control circuit is mounted in a sealed case, and the temperature/humidity sensor is placed outside of the case in such a manner that the temperature/humidity sensor TS1 and the case are connected to each other via a cable. However, in this case, the temperature/humidity sensor is placed outside of the case, so it is necessary to separately consider the method of fixing the temperature/humidity sensor and the mounting of the sensor, which complicates the mounting, leading to an increase in mounting cost.

This invention enables the temperature/humidity sensor TS1 and the control circuit for the sensor node SN1 to be mounted in one case.

FIG. 33 shows an embodiment of a sensor node that senses a temperature/humidity.

In an external case SN-NODE, in the same way as in the first embodiment, a board BO1 on which an RF chip and a microprocessor are placed, a board BO2-2 on which an interface circuit between a power supply control circuit and a sensor is placed, a power supply BAT, a connector SMA1 for connecting an antenna ANT1, and an internal case SN-CAP (partition wall) containing a temperature/humidity sensor board BO3-2 are mounted.

In the internal case SN-CAP, the temperature/humidity sensor board BO3-2 is contained. In the internal case SN-CAP, a temperature/humidity passage window WN1 for taking in outside air is present, and the temperature/humidity passage window WN1 enables the temperature and humidity of the outside air to be measured. In other words, the inside of the internal case SN-CAP becomes a space for containing the temperature/humidity sensor board BO3-2, and the outside of the internal case SN-CAP and the inner circumference of the external case SN-NODE become a second space for containing the board BO1, the board BO2-2, and the power supply BAT.

The external case SN-NODE has an O-ring ORNG1 for water resistance on a contact surface between the internal case SN-CAP and the external case SN-NODE, and has an O-ring ORNG2 on a contact surface between the antenna connector SMA1 and the external case SN-NODE. Because of this, the air in the external case SN-NODE is completely separated from the air outside the case.

Furthermore, an interface signal between the board BO2-2 and the board BO3-2 passes through the internal case SN-CAP, and an O-ring ORNG3 for water resistance is mounted on a contact surface between the internal case SN-CAP and the external case SN-NODE. Because of this, the air in the internal case SN-CAP is separated completely from the air inside the external case SN-NODE.

The inside of the external case SN-NODE is sealed with those three O-rings. Therefore, condensation does not occur due to the change in temperature and humidity, and the reliability of the control circuit is enhanced. Furthermore, the temperature/humidity sensor is also mounted in the case, which means that the sensor is also mounted together with the control circuit in one case. Thus, the mounting becomes compact, and the setting of a sensor node becomes easy.

Figure 34:
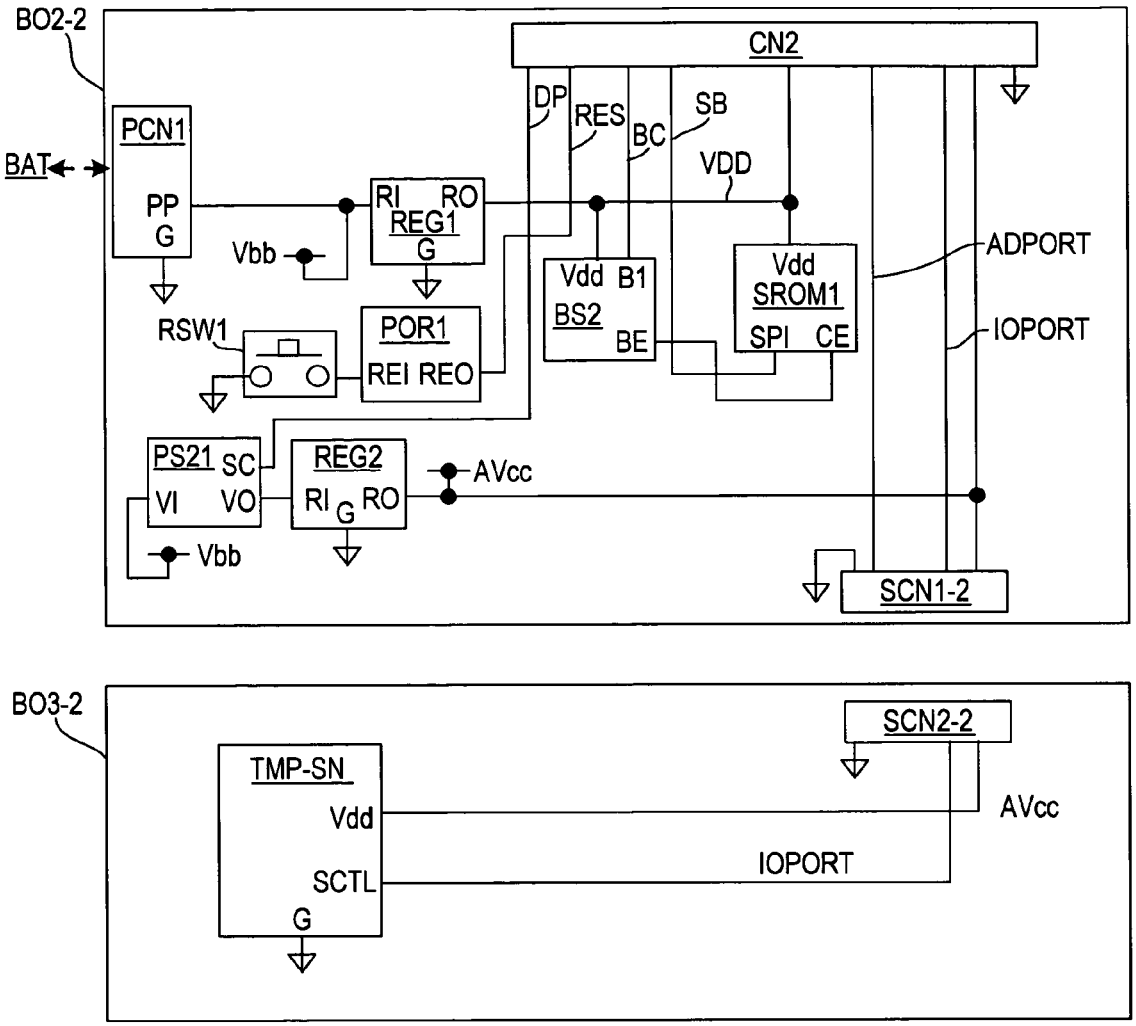
FIG. 34 is a structural diagram showing an example of a board BO2-2 and a temperature and humidity sensor board BO3-2 in the second embodiment.

FIG. 34 shows configurations of the boards BO2-2 and BO3-2 used in this embodiment. The board BO2-2 has an interface with respect to the board BO1 on which the RF chip and the microprocessor chip are placed, an interface with respect to the temperature/humidity sensor board BO3-2, and an interface with respect to the power supply BAT. On the board BO2-2, a regulator REG1 as a power supply for supplying a power to various kinds of circuits mounted on the boards BO1 and BO2-2, a power-on reset switch RSW1, a power-on reset circuit POR1, a bus-select circuit BS2, a non-volatile memory SROM1, a power supply regulator for a temperature/humidity sensor REG2, and an on/off control circuit PS21 of the power supply regulator for a temperature/humidity sensor REG2 are mounted. Those circuits are controlled with control signals (digital port DP, bus control signal BC, serial-bus control SB) from the board BO1.

On the temperature/humidity sensor board BO3-2, a temperature/humidity sensor TMP-SN is mounted. A control signal DP from the board BO1 controls the temperature/humidity sensor TMP-SN via the board BO2-2. The control signal DP is composed of a bidirectional data signal controlling the sensor and a clock signal showing weather or not a data signal at an effective timing, and the control signal and data can be transmitted/received at a timing of the clock signal.

The procedure of sensing of the temperature/humidity sensor TM-SN will be described briefly. The board BO1 controls an interval for sensing temperature and humidity. For example, if the measurement period is 5 minutes, the period of 5 minutes is measured. After the elapse of 5 minutes, the data on temperature and humidity is read from the temperature/humidity sensor TMP-SN with the control signal DP, and transferred to a basestation BS10 through an RF circuit by radio communication. The basestation BS10 transfers information on temperature and humidity to a data server and an application system, using a communication line such as the Internet and intranet.

The measurement of temperature and humidity and the transfer of the measurement data are performed periodically. According to the configuration shown in this embodiment, a sensor node that operates stably at low cost can be realized.

In this embodiment, the temperature/humidity sensor TMP-SN controlled with a digital signal has been described. In the case of a temperature/humidity sensor controlled with an analog signal, the analog signal is converted to a digital signal with the board BO1, and then data may be transferred by radio communication. The mounting configuration of this embodiment is also applicable to the temperature/humidity sensor of an analog output.

In each of the above-mentioned embodiments, an example in which the sensor node SN1 is worn on the arm has been illustrated. However, the sensor node SN1 can be worn by any site (e.g., a leg) from which a pulsebeat can be measured.

As described above, according to this invention, a wristband sensor node can be provided in which a chip-type dielectric antenna is placed away from a human body, whereby stable radio communication with high sensitivity can be ensured, and stable radio communication with a small power consumption can be performed.

Furthermore, the sensor node of this invention can be used continuously over a long period of time with a very low power consumption while a plurality of sensors are mounted. Therefore, the sensor node is applicable to the case where a long-term use is required without maintenance, as in the medical care, nursing care and the like.

While the present invention has been described in detail and pictorially in the accompanying drawings, the present invention is not limited to such detail but covers various obvious modifications and equivalent arrangements, which fall within the purview of the appended claims.

What is claimed is:

1. A sensor node having a radio-communication circuit and a sensor, for transmitting data obtained by the sensor by radio communication, comprising:

a chip-type dielectric antenna which is connected to the radio-communication circuit;

a first board which has a first surface on which the antenna is placed and a second surface opposed to the first surface;

a case for containing the first board; and a band attached to the case to fix the case to a skin of a human wrist, wherein a power supply layer and a ground layer are provided in the first board, wherein the case is fixed to the skin by the band to position the second surface closer than the first surface to the skin and the antenna in an upper portion of the case in a 12 o'clock direction of a wristwatch when placed on the human wrist, and wherein an area surrounding the antenna is set on the first board and no conductive plane is provided in the power supply layer and the ground layer inside the area.

2. The sensor node according to claim 1, wherein the band is attached from an end portion of the case in the 12 o'clock direction of the wristwatch to an end portion of the case in a 6 o'clock direction of the wristwatch.

3. The sensor node according to claim 1, wherein, when the sensor node is worn on a left human wrist, the antenna is located in an upper left corner of the case.

4. The sensor node according to claim 1, wherein the first board has a display unit placed in a central portion of the case, and the case exposes the display unit to be visible from outside of the case.

5. The sensor node according to claim 1, wherein the sensor comprises a light-emitting element and a light-receiving element set to face towards the skin, and the light-emitting element and the light receiving element align along of a center line of the case.

6. A sensor node having a radio-communication circuit and a sensor, for transmitting data measured by the sensor by radio communication, comprising:

a first board on which a chip-type dielectric antenna connected to the radio-communication circuit is placed, wherein a power supply layer and a ground layer are provided in the first board;

a battery for supplying a power to the radio-communication circuit and the sensor;

a case for containing the first board;

a band attached to the case for fixing the case to a skin; and a light-emitting element and a light-receiving element placed at a position opposed to the skin, wherein the antenna is placed at a position opposed to the case and corresponding to an upper portion of the case on a first surface of the first board, and the battery is placed at a position corresponding to a lower portion of the case on a second surface of the first board, the band is connected to the upper portion and the lower portion of the case to be wearable to an arm, the light-emitting element and the light-receiving element are placed on an axis orthogonal to a center of a line connecting upper and lower directions of the case, the sensor is configured so that a plurality of light-emitting elements sandwich the light-receiving element, and wherein an area surrounding the antenna is set on the first board and no conductive plane is provided in the power supply layer and the ground layer inside the area.

7. The sensor node according to claim 5, wherein an opening through which the light-emitting element and the light-receiving element face towards the skin is provided on a bottom surface of the case which contacts the skin.

8. The sensor node according to claim 1, wherein the case contains a second board which is positioned between the second surface of the first board and a bottom surface of the case contacting the skin and which has a power supply circuit and a ground circuit formed thereon, excluding an area opposed to a no ground/power plane area formed surrounding the antenna.

9. The sensor node according to claim 1, wherein the case contains another board which exists between the second surface of the first board and a bottom surface of the case and which has members having a ground potential.

10. The sensor node according to claim 9, wherein the members having the ground potential are a control apparatus for controlling the radio-communication circuit and the sensor, and a battery for supplying a power to the radio-communication circuit, the sensor, and the control apparatus.

11. The sensor node according to claim 1, wherein the antenna is a chip-type dielectric antenna composed of a high dielectric substance.

12. The sensor node according to claim 1, wherein the sensor includes a humidity sensor for measuring a humidity, the case has a partition wall for partitioning a first space containing the humidity sensor from a second space containing the first board, and a window portion for introducing an outside air.

13. The sensor node according to claim 1, further comprising a battery for supplying a power to the radio communication circuit and the sensor, wherein the battery is placed on the second surface of the first board excluding a no ground/power-plane area formed surrounding the antenna.

14. The sensor node according to claim 1, farther comprising a battery for supplying a power to the radio communication circuit and the sensor, wherein the battery is placed on the second surface of the first board in a lower portion of the case in a 6 o'clock direction of the wristwatch.

15. The sensor node according to claim 4, wherein the first board has an operation switch existing in a lower portion of the case in a 6 o'clock direction of the wristwatch, and the case exposes the operation switch to be visible from outside of the case.

16. A sensor node having a radio-communication circuit, a sensor, and a display unit, for transmitting data obtained by the sensor by radio communication, comprising:

a chip-type dielectric antenna which is connected to the radio-communication circuit;

a board having one surface mounted with the antenna and the display unit are placed; and a case for containing the board, wherein a power supply layer and a ground layer are provided in the first board, wherein the display unit is positioned in a central portion of the case, the antenna is positioned in an upper portion of the case in a 12 o'clock direction of a wristwatch if placed on the human wrist, and wherein an area surrounding the antenna is set on the first board and no conductive plane is provided in the power supply layer and the ground layer inside the area.

17. The sensor node according to claim 16, wherein when the sensor node is worn on a left human wrist, the antenna is located in an upper left corner of the case.

18. The sensor node according to claim 16, further comprising a battery for supplying a power to the radio-communication circuit and the sensor, wherein the battery is placed on another surface opposed to the surface of the first board excluding the no ground/power-plane area formed surrounding the antenna.

19. The sensor node according to claim 5, wherein the sensor is configured so that a plurality of light-emitting elements sandwich the light-receiving element.

20. The sensor node according to claim 1, wherein a ground/power circuit is embedded in flip ground layer, a power supply is embedded in the power supply layer, and the ground layer and the power supply layer cover over the first surface of the first board excluding the no ground/power-plane area.

21. The sensor node according to claim 6, wherein a ground/power circuit is embedded in the ground layer, a power supply is embedded in the power supply layer, and the ground layer and the power supply layer cover over the first surface of the first board excluding the no ground/power-plane area.

22. The sensor node according to claim 6, wherein a ground/power circuit is embedded in the ground layer, a power supply is embedded in the power supply layer, and the ground layer and the power supply layer cover over the first surface of the first board excluding the no ground/power-plane area.

* * * * *

UNITED STATES PATENT AND TRADEMARK OFFICE

CERTIFICATE OF CORRECTION

PATENT NO. : 7,626,498 B2
APPLICATION NO. : 11/208632
DATED : December 1, 2009
INVENTOR(S) : Aiki et al.

It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 143 days.

Signed and Sealed this

Second Day of November, 2010

David J. Kappos

David J. Kappos
*Director of the United States Patent and Trademark Office*